US005314796A

United States Patent [19]

Murai et al.

[11] Patent Number: 5,314,796

[45] Date of Patent: May 24, 1994

[54] SILVER HALIDE COLOR PHOTOGRAPHIC LIGHT SENSITIVE MATERIAL

[75] Inventors: Kazuhiro Murai; Makoto Kajiwara, both of Odawara; Hirokazu Sato, Hino; Shinri Tanaka, Hino; Mitsuhiro Okumura, Hino, all of Japan

[73] Assignee: Konica Corporation, Tokyo, Japan

[21] Appl. No.: 37,894

[22] Filed: Mar. 26, 1993

[30] Foreign Application Priority Data

Apr. 2, 1992 [JP] Japan ..... 4-080949
Apr. 2, 1992 [JP] Japan ..... 4-080951

[51] Int. Cl.[5] ..... G03C 1/06

[52] U.S. Cl. ..... 430/522; 430/551; 430/504; 430/611; 430/557; 430/607

[58] Field of Search ..... 430/517, 522, 551, 504, 430/611, 557, 607

[56] References Cited

U.S. PATENT DOCUMENTS

| | | | |
|---|---|---|---|
| 1,845,404 | 2/1932 | Durr et al. | 430/522 |
| 2,493,747 | 1/1950 | Brooker et al. | 430/577 |
| 2,843,486 | 7/1958 | Bailey | 430/522 |
| 2,895,826 | 7/1959 | Salminen et al. | 430/384 |
| 3,247,127 | 4/1966 | Bailey | 430/507 |
| 3,294,539 | 12/1966 | Bailey | 430/522 |
| 3,772,002 | 11/1973 | Ramello | 430/553 |
| 4,183,756 | 1/1980 | Locker | 430/569 |
| 4,225,666 | 9/1980 | Locker et al. | 430/569 |
| 4,443,536 | 4/1984 | Lestina | 430/552 |
| 4,607,004 | 8/1986 | Ikenoue et al. | 430/611 |
| 4,997,752 | 3/1991 | Sasaki et al. | 430/607 |
| 5,001,042 | 3/1991 | Hasebe | 430/522 |
| 5,059,516 | 10/1991 | Sato et al. | 430/607 |
| 5,180,659 | 1/1993 | Murai et al. | 430/522 |
| 5,185,240 | 2/1993 | Miyata et al. | 430/607 |

FOREIGN PATENT DOCUMENTS

| | | |
|---|---|---|
| 0367227 | 5/1990 | European Pat. Off. . |
| 0459334 | 12/1991 | European Pat. Off. . |

*Primary Examiner*—Richard L. Schilling
*Assistant Examiner*—Thomas R. Neville
*Attorney, Agent, or Firm*—Frishauf, Holtz, Goodman & Woodward

[57] ABSTRACT

A silver halide color photographic light sensitive material excellent in both sharpness and whiteness of background while being capable of satisfactorily displaying the yellow coupler characteristics including an excellent color reproduction is provided, wherein the silver halide color photographic light sensitive material contains a compound represented by the following Formula [I] in at least one of the photographic component layers thereof, a compound represented by the following Formula [II] in at least one of the silver halide emulsion layers thereof, and a compound represented by the following Formula [III] in at least one of the photographic component layers; and Formula [I]

Formula [II]

Formula [III]

12 Claims, No Drawings

SILVER HALIDE COLOR PHOTOGRAPHIC LIGHT SENSITIVE MATERIAL

FIELD OF THE INVENTION

This invention relates to a silver halide color photographic light sensitive material and, particularly, to a silver halide color photographic light sensitive material excellent in color reproduction and image sharpness, high in color image density and low in fog density.

BACKGROUND OF THE INVENTION

In the silver halide photographic light sensitive materials such as a direct appreciation type color print paper treated in a subtractive color system, the improvements of dye image qualities have been demanded more in recent years and, particularly, the improvements of the color reproduction, image sharpness and white background have been strongly demanded among the improvements of the image qualities.

Usually in the subtractive color systems and for forming yellow, magenta and cyan dye images, yellow couplers such as those of the acylacetamido type, magenta couplers such as those of the 5-pyrazolone type, pyrazoloazole type and pyrazolobenzimidazole type and cyan couplers such as those of the phenol type and naphthol type have been preferably used. Particularly among the couplers, each of the conventional yellow couplers has formed a dye having the maximum absorption wavelength of the positioned generally on the longer wavelength side from the wavelength for the absorption characteristics preferable from the viewpoint of the color reproduction. A yellow coupler has been disclosed in Japanese Patent Publication Open to Public Inspection (hereinafter referred to as JP OPI Publication) Nos. 63-123047/1988 and 63-231451/1988, in which the maximum absorption wavelength is shifted to the shorter wavelength side and the absorption in the longer wavelength side is sharpened.

On the other hand, the magenta couplers of the pyrazoloazole type and the cyan couplers of the phenol type are advantageous from the viewpoints of color reproduction.

When making combination use of the above-mentioned yellow, magenta and cyan couplers, the considerable improvements the hue can be observed in yellow, yellowish green, green, bluish green, orange, red and so forth. However, on the other hand, monochromatic yellow density is required to increase more than in the past because the visual yellow density is substantially low, though it is excellent for the yellow color reproduction. It has therefore been demanded for providing a silver halide color photographic light sensitive material advantageous for making the color forming property higher than before.

Relating a color forming property and a photosensitive speed, it has been known that the configurations, sizes and compositions of the silver halide grains of the silver halide emulsions applied to a light sensitive material influence greatly upon the development speeds and so forth. In particular, it has been known that the silver halide compositions greatly influence thereupon and a high development speed can be performed when making use of a highly chloride-containing silver halide.

When a development speed is increased, there may often be the instances where a fog density is eventually increased, and a variety of inhibitors have been applied as an antifoggant to light sensitive materials.

On the other hand, for the achievement of high image quality, it is one of the essential keys to improve the image sharpness. As for the sharpness improvement means, there has been a known method in which a silver halide photographic emulsion layer or other hydrophilic colloidal layer is colored with a dye capable of absorbing light having a specific wavelength so as to improve the optical properties of a support and to prevent a halation and an irradiation.

The dyes applicable to light sensitive materials are ordinarily used in embodiments and can play the roles as follows.

(1) In order to modify the spectral component of an incident light reaching a photographic emulsion layer or change the incident light quantity so that the sensitivity can be controlled, a colored layer is provided to the side of the photographic emulsion layer farther from the support of a light sensitive material so as to cut off any unnecessary light. Such a colored layer as mentioned above is called a filter layer and, when plural emulsion layers are provided, the filter layer may sometimes be interposed between one and the other emulsion layers.

(2) A colored layer is interposed between a photographic emulsion layer and a support or provided to the surface of the support opposite to the emulsion layer so as to prevent any image blur produced when the light transmitted through the emulsion layer are reflected on the interface between the emulsion layer and the support or reflected on the surface of the support opposite to the emulsion layer and the reflected light are then made incident again into the emulsion layer; that is to prevent any halation. Such a colored layer is called an antihalation layer. When plural emulsion layers are provided thereto, the antihalation layer may sometimes be interposed between one and the other emulsion layers.

(3) A photographic emulsion layer is colored for preventing any light scattering (generally called irradiation) produced by the silver halide grains contained in the photographic emulsion layer.

The dyes applicable with the above-mentioned purposes are to satisfy the following various requirements; the dyes are to display the spectral absorption characteristics capable of excellently meeting the purposes of application; the dyes are to be decolored completely in a photographic processing solution and readily dissolved out of the subject light sensitive material so that any residual color stains produced by the dyes can be eliminated after completing the treatments; the dyes are not to affect any spectrally sensitized photographic emulsions by any sensitization, desensitization or fog production; the dyes are to be excellent in aging stability and not to be faded, nor decolored in any processing solutions or a light sensitive material.

For the purpose of finding out the dyes capable of satisfying the above-mentioned requirements, many studies have been made and a variety of dyes have been proposed so far. For example, the oxonol dyes proposed in British Patent No. 506,385, U.S. Pat. No. 3.247.127, JP Examined Publication Nos. 39-22069/1964 and 43-13168/1968; the styryl dyes proposed typically in U.S. Pat. No. 1,845,404; the merocyanine dyes proposed in U.S. Pat. No. 2,493,747 and British Patent No. 1,542,807; the cyanine dyes proposed in U.S. Pat. Nos. 2,843,486 and 3,294,539; and the anthraquinone dyes proposed typically in U.S. Pat. No. 2,865,752.

Among the above-given dyes, oxonol type dyes and anthraquinone type dyes are comparatively few to adversely affect any photographic emulsions and, therefore, they have been preferably used in silver halide color photographic light sensitive materials for direct appreciation use.

The present inventors have variously studied of the above-mentioned dyes to discover the dyes which are advantageous for improving the image sharpness and are also capable of satisfying every one of the aforementioned requirements of which the dyes are to be completely decolored in a photographic processing solution, the dyes are to be readily dissolved out of a light sensitive material so that any residual color stains cannot be produced by the dyes after completing processing; any spectrally sensitized photographic emulsions are not to be affected by any sensitization, desensitization nor fog production; and the dyes are to be excellent in aging stability in any solutions or light sensitive materials.

Resultingly, the present inventors have discovered that the dyes each having a specific structure are capable of achieving the above-mentioned purposes.

However, when making use of the above-mentioned specific dyes in combination with a silver halide color photographic light sensitive material applied with the aforementioned highly chloride-containing silver halide and the aforementioned yellow coupler excellent in color reproduction, it has been proved that a problem of increasing fog is raised. A fog increase will lead to spoil background whiteness which is essential for making image quality higher. It has also been found that the deterioration of the white background will further become serious in a rapid processing treatment which has been strongly demanded in recent years, and in a low-replenishing treatment.

In the above-mentioned combination use, another new problem has been raised to increase the absorption in the long wavelength region exceeding 550 nm of a dye formed from a yellow coupler and then not to sharply decay to zero.

Therefore, the conventional techniques have been difficult to provide any silver halide color photographic light sensitive material capable of satisfying every requirement particularly for obtaining the excellent color reproduction and sufficiently high color density of a yellow dye, the image sharpness and the white background property.

SUMMARY OF THE INVENTION

It is accordingly an object of the invention to provide a silver halide color photographic light sensitive material excellent in image sharpness and background whiteness with satisfactorily displaying advantageous characteristics of a yellow coupler in color reproduction.

The above-mentioned object of the invention can be achieved as follows.

(1) A silver halide color photographic light sensitive material comprising a support bearing thereon photographic component layers including a light sensitive silver halide emulsion layer, characterized in containing a compound represented by the following Formula [I] in at least one of the photographic component layers, a compound represented by the following Formula [II] in the silver halide emulsion layer and a compound represented by the following Formula [III] in at least one of the photographic component layers.

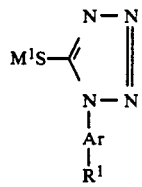

Formula [I]

wherein Ar represents an aromatic group; and $R^1$ represents $—OR^2$, $—N(R^3)SO_2R^4$ or $—COOM^2$ in which $R^2$ represents a hydrocarbon group having 2 or more carbon atoms, $R^3$ represents a hydrogen atom or a hydrocarbon group, and $R^4$ represents a hydrocarbon group; and wherein $M^1$ and $M^2$ represent each a hydrogen atom, an alkali metal atom, an alkaline earth metal atom or an ammonium group.

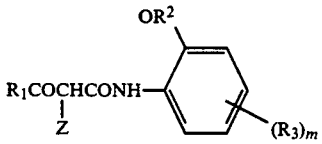

Formula [II]

wherein $R_1$ represents an alkyl group or a cycloalkyl group; $R_2$ represents an alkyl group, a cycloalkyl group or an aryl group; $R_3$ represents a group substitutable on a benzene ring; and m is an integer of 0 to 4, provided that when m is pluralized, $R_3$s may be the same with or different from each other; and Z represents a hydrogen atom or a group capable of splitting off when it is coupled to the oxidized product of a developing agent.

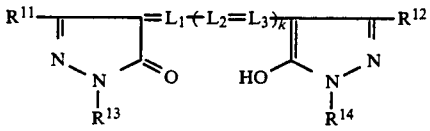

Formula [III]

wherein $R^{11}$ and $R^{12}$ represent each —CN, $—COR^{15}$, $—COOR^{15}$ or $—CONR^{16}R^{17}$; $R^{13}$ and $R^{14}$ represent each a hydrogen atom, an alkyl group, a cycloalkyl group, an aryl group or a heterocyclic group; $L_1$, $L_2$ and $L_3$ represent each a methine group; k is an integer of 0, 1 or 2, provided that when k is 2, $—L_2=L_3—$s may be the same with or different from each other; and $R^{15}$ represents an alkyl group or an aryl group.

$R^{16}$ and $R^{17}$ represent each a hydrogen atom, an alkyl group, an alkenyl group, an aryl group or a heterocyclic group, provided that $R^{16}$, $R^{17}$ and a nitrogen atom adjacent thereto are allowed to form a 5- or 6-membered ring and that $R^{16}$ and $R^{17}$ shall not represent hydrogen atoms at the same time.

At least one of $R^{11}$, $R^{12}$, $R^{13}$ and $R^{14}$ represents a water-soluble group or a group having a water-soluble group.

(2) A silver halide color photographic light sensitive material characterized in that $R_3$ having been denoted in the compounds represented by the aforegiven Formula [II] is represented by the following Formula [IV].

$$—NHCOR_5$$

Formula [IV]

wherein $R_5$ represents an alkyl group.

(3) A silver halide color photographic light sensitive material described in Item (1) above and characterized in that at least one of the silver halide emulsion layers contains a silver halide emulsion having a silver chloride content of not less than 95 mol %.

DETAILED DESCRIPTION OF THE INVENTION

First, the compounds represented by Formula [I] will be detailed below.

In Formula [I], Ar represents an aromatic group including, for example, a phenyl group, a naphthyl group and a pyridyl group, provided, these aromatic groups may have substituents.

When Ar represents a phenyl group, it is preferable, because the effects of the invention can remarkably be displayed.

In Formula [I], $R^1$ represents $—OR^2$, $—N(R^3)SO_2R^4$ or $—COOM^2$, wherein $R^2$ represents a hydrocarbon atom having 2 or more carbon atoms, which includes, for example, an alkyl group such as an ethyl group, a hexyl group and a dodecyl group, and an aryl group such as a phenyl group, a p-t-butylphenyl group, a m-methoxyphenyl group and an o-methoxyphenyl group. $R^2$ represents preferably an alkyl group, because the effects of the invention can remarkably be displayed. It is also preferable that $R^1$ represents $—N(R^3)SO_2R^4$ or $—OR^2$.

$R^3$ represents a hydrogen atom or a hydrocarbon group. The examples of the hydrocarbon groups include the same groups as the groups represented by $R^2$, as well as the methyl groups. When $R^3$ represents a hydrogen atom, it is preferable, because the effects of the invention can remarkably be displayed.

$R^4$ represents a hydrocarbon atom including, for example, the same groups as the hydrocarbon groups represented by $R^3$.

In Formula [II], $M^1$ and $M^2$ represent each a hydrogen atom, an alkali metal atom, an alkaline earth metal atom or an ammonium group. The examples of the metal atoms include those of sodium, lithium, potassium or calcium. When a metal atom is divalent or more, the anions are made bonded because the electric charge is neutralized. When $M^1$ represents a hydrogen atom, it is preferable, because the effects of the invention can remarkably be displayed.

The compounds represented by Formula [I] will typically be exemplified below. It is the matter of course that the invention shall not be limited to the following exemplified compounds.

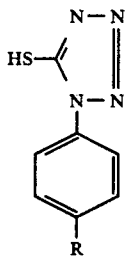

| No. | R |
|---|---|
| 1 | $—OCH_2CH_3$ |
| 2 | $—O(CH_2)_3CH_3$ |
| 3 | $—O(CH_2)_5CH_3$ |
| 4 | $—O(CH_2)_7CH_3$ |
| 5 | $—O(CH_2)_{11}CH_3$ |

-continued

6 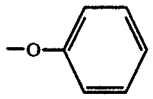

7 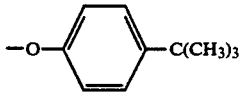

8 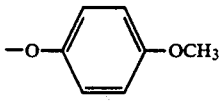

9 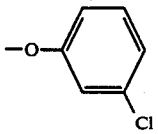

10 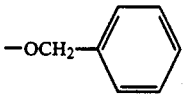

11 $—OCH_2CH=CH_2$
12 $—OCH_2C\equiv CH$
13 $—NHSO_2CH_3$
14 $—NHSO_2(CH_2)_3CH_3$
15 $—NHSO_2CH(CH_3)_2$ 16 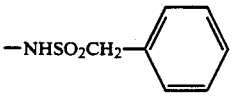

17 $—NHSO_2CH_2CF_3$
18 $—NHSO_2(CH_2)_3Cl$

19 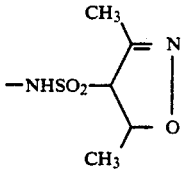

20 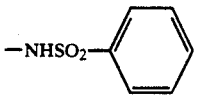

21 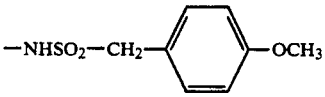

22 $—NHSO_2CH_2CH=CH_2$
23 $—NHSO_2CH_2C\equiv CH$
24 $—NHSO_2N(CH_3)_2$
25 $—NHSO_2(CH_2)_7CH_3$
26 $—COOH$
27 $o\text{-}OCH_2CH_3$
28 $o\text{-}O(CH_2)_3CH_3$ 29 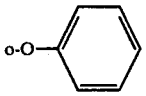

-continued

| | |
|---|---|
| 30 | 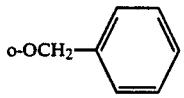 |
| 31 | o-$OCH_2CH{=}CH_2$ |
| 32 | m-$OCH_2CH_3$ |
| 33 | m-$O(CH_2)_5CH_3$ |
| 34 | 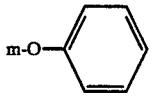 |
| 35 | 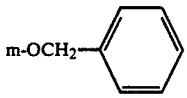 |
| 36 | o-$NHSO_2CH_3$ |
| 37 | o-$NHSO_2(CH_2)_2CH_3$ |
| 38 | 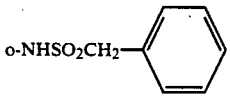 |
| 39 | o-$NHSO_2CH_2CH{=}CH_2$ |
| 40 | m-$NHSO_2CH_2$ |
| 41 | m-$NHSO_2(CH_2)_3CH_3$ |
| 42 | m-$NHSO_2CH(CH_3)_2$ |
| 43 | 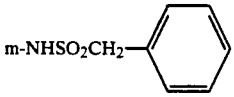 |
| 44 | 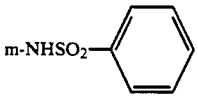 |
| 45 | m-$NHSO_2N(CH_3)_2$ |
| 46 | m-$NHSO_2(CH_2)_7CH_3$ |
| 47 | m-COOH |
| 48 | m-COONa |
| I-49 | 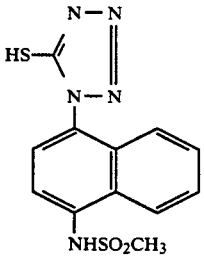 |
| I-50 | 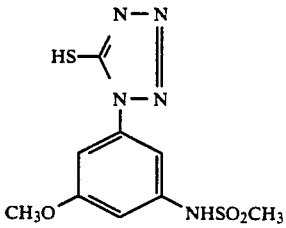 |

-continued

| | |
|---|---|
| I-51 | 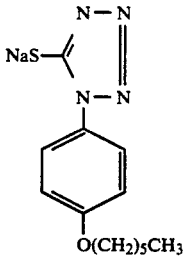 |
| I-52 | 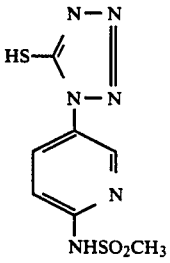 |

The above-given compounds can be synthesized with reference to J. Chem. Soc., 49, 1748 (1927); J. Org. Chem, 39, 2469 (1965); JP OPI Publication No. 50-89034/1975, Ann. Chem., 44-3, 1954; JP Examined Publication No. 40-28496/1965; Chem. Ber., 20. 231 (1887); U.S. Pat. No. 3,259,976; and so forth.

The compound represented by Formula [I] (hereinafter called Compounds [I]) can be contained in any desired places of light sensitive materials. The compounds [I] may be contained, preferably, in any one of the hydrophilic colloidal layers of photographic component layers and, more preferably, in a silver halide emulsion layer.

Compound [I] may be contained in a silver halide emulsion containing the silver halide grains relating to the invention, by dissolving them in water or an organic solvent (such as methanol and ethanol) capable of being readily miscible with water and then adding the mixture thereof in the emulsion. It is also allowed to make use of Compounds [I] independently or in combination or to make combination use thereof with a stabilizer or antifoggant other than the compound represented by Formula [I].

Compound [I] can be added at the time in the course of forming silver halide grains, at the period between the time after completing the formation of the silver halide grains and the time before starting a chemical sensitization thereof, at the time of starting the chemical sensitization, in the course of carrying out the chemical sensitization, at the time of completing the chemical sensitization, and in any point of time selected from the period between the time when completing the chemical sensitization and the time when carrying out a coating solution preparation step.

Compound [I] may be added in any amounts without any special limitation. However, the compound may be usually added in an amount within the range of $1\times10^{-7}$ mols to $1\times10^{-1}$ mols and, preferably, $1\times10^{-6}$ mols to $1\times10^{-2}$ mols, each per mol of silver halide used.

Silver halides applicable to the silver halide emulsion layer of the invention include any silver halides such as silver chloride, silver bromide, silver iodide, silver chlorobromide, silver iodobromide and silver chloroiodide.

The silver halide grains applicable to the invention have each a silver chloride content of not less than 95 mol % and they are preferable to have each a silver bromide content of not more than 5 mol % and a silver iodide content of not more than 0.5 mol %. The more preferable silver halide grains are those comprising silver chlorobromide having a silver bromide content within the range of 0.1 to 2 mol %. The silver halide grains may be used independently or mixedly with other silver halide grains having any different halide compositions. They may also be used upon mixing them with silver halide grains having a silver chloride content of not more than 95 mol %. In a silver halide emulsion layer containing silver halide grains having a silver chloride content of not less than 95 mol %, the proportion of the silver halide grains having a silver chloride content of not less than 95 mol % to the whole silver halide grain contained in the emulsion layer is not less than 50 wt% and, preferably, not less than 80 wt%. The compositions within the silver halide grain may be either uniform throughout from the interior of the grains to the exterior thereof or different between the interior and the exterior. When the latter is the case, the compositions may be varied continuously or discontinuously either.

The silver halide grain sizes shall not specially be limited, but the grain sizes thereof are to be within the range of, preferably, 0.2 to 1.6 μm and, more preferably, 0.25 to 1.2 μm by taking a rapid processability, photosensitive speeds and other photographic characteristics into consideration.

The grain size distribution of silver halide grains may be polydispersed or monodispersed. In the grain size distribution of silver halide grains, the monodisperse type silver halide grains having a variation coefficient of, preferably, not more than 0.22 and, more preferably, not more than 0. 15 are preferred. Therein, the term, a variation coefficient, is a coefficient indicating the breadth of the grain size distribution and is also defined by the following formula.

$$\text{Variation coefficient} = \frac{\text{Standard deviation of grain size distribution}}{\text{Average grain size}}$$

The silver halide grains applicable to the invention may be those prepared in either one of an acidic method, a neutral method and an ammoniacal method. The grains may be grown up either at a time or after preparing seed grains. The methods for reacting a soluble halide with a soluble silver salt may include any one of normal precipitation methods, reversed precipitation methods, double-jet precipitation methods and the combinations thereof. Among these reaction methods, the double-jet precipitation methods are preferable. It is further allowed to use the pAg-controlled double-jet method detailed in JP OPI Publication No. 54-48521/1979 as one of the double-jet precipitation methods.

If required, it is further allowed to use a silver halide solvent such as thioether and imidazole. It is still further allowed to add a compound such as a mercapto group-containing compound, a nitrogen-containing heterocyclic compound and a sensitizing dye when forming silver halide grains or after completing the formation of the grains.

Silver halide grains having any desired configurations can be used in the invention. One of the preferable examples is cubic grains having {100} faces as the crystal faces thereof. The grains having an octahedral, tetradecahedral or dodecahedral configuration are prepared in any one of the methods detailed in the literatures such as U.S. Pat. Nos. 4,183,756 and 4,225,666, JP OPI Publication No. 55-26589/1980, JP Examined Publication No. 55-42737/1980, The Journal of Photographic Science, 21, 39 (1973), and then the resulting grains may be used. In addition to the above, any grains having twinned crystal planes may also be used. The silver halide grains applicable to the invention may be those having a single configuration or those mixed with the grains having various configurations.

In the invention, metal ions are added by making use of a cadmium salt, zinc salt, lead salt, thallium salt, iridium salt (including the complex salts thereof), rhodium salt (including the complex salts thereof) or iron salt (including the complex salts thereof) in the courses of nucleating and/or growing silver halide grains, so that the metal ions can be contained inside and/or the surfaces of the grains. When producing a suitable reducible atmosphere, a reduction sensitization nuclei can also be provided inside and/or the surfaces of the grains.

After completing the growth of silver halide grains, any unnecessary soluble salts may be removed from an emulsion containing silver halide grains or may remain contained in the emulsion.

In the invention, the silver halide grains applicable to an emulsion may be those capable of mainly forming a latent image on the surfaces thereof or may be those capable of mainly forming a latent image inside the grains. However, the grains capable of mainly forming a latent image on the surfaces thereof are preferable.

In the invention, an emulsion is chemically sensitized in an ordinary method. To be more concrete, the following sensitization methods are applicable thereto independently or in combination, namely, a sulfur sensitization method in which a sulfur-containing compound capable of reacting with silver ions, a selenium sensitization method in which a selenium compound is used, a reduction sensitization method in which a reducing substance is used, and a noble metal sensitization method in which gold or other noble metals are used.

An emulsion may be spectrally sensitized to any desired wavelength region by making use of a sensitizing dye. The sensitizing dye applicable thereto include, for example, a cyanine dye, merocyanine dye, composite cyanine dye, composite merocyanine dye, holopolar cyanine dye, hemicyanine dye, styryl dye and hemioxanol dye. The concrete examples thereof include, for example, Exemplified Compounds BS-1 through BS-9, GS-1 through GS-5, RS-1 through RS-8 and IRS-1 through IRS-10 each given in JP Application No. 2-76278/1990. The super sensitizers applicable thereto in combination include, for example, Exemplified Compounds SS-1 through SS-9 each given in JP Application No. 2-76278/1990.

The dye-forming couplers applicable to the light sensitive materials of the invention are usually selected so as to form dyes each capable of absorbing the photosensitive spectra of emulsion layers, respectively. A yellow dye forming coupler is used in a blue-sensitive emulsion layer; a magenta dye forming coupler, in a green-sensitive emulsion layer; and a cyan dye forming coupler, in a red-sensitive emulsion layer, respectively. However, it is also allowed to prepare a color light sensitive material in a way different from the above-mentioned combination so as to meet the purposes.

Now, the compounds represented by Formula [II] will be detailed below.

In the foregoing Formula [II], the alkyl groups represented by $R_1$ include, for example, a straight-chained or branched alkyl group such as methyl group, ethyl group, i-propyl group, t-butyl group, n-dodecyl group and 1-hexylnonyl group; and the cycloalkyl groups represented by $R_1$ include, for example, a cyclopropyl group, cyclohexyl group and adamantyl group. The alkyl and cycloalkyl groups represented by $R_1$ may further have each a substituent. The substituents include, for example, a halogen atom (such as chlorine atom and bromine atom), a cyano group, a nitro group, an aryl group (such as a phenyl group, p-t-octylphenyl group and 2,4-di-t-amylphenyl group), a hydroxyl group (such as methoxy group and 2-ethoxyethoxy group), an aryloxy group (such as phenoxy group, 2,4-di-t-amylphenoxy group and 4-(4-hydroxyphenylsulfonyl)phenoxy group), a heterocyclic-oxy group (such as 4-pyridyloxy group and 2-hexahydropyranyloxy group), a carbonyloxy group (such as alkylcarbonyloxy groups, e.g., acetyloxy group and pivaloyloxy group, aryloxy groups, e.g., benzoyloxy group), a sulfonyloxy group (such as alkylsulfonyloxy groups, e.g., methanesulfonyloxy group, trifluoromethanesulfonyloxy group and n-dodecansulfonyloxy group, and arylsulfonyloxy groups, e.g., benzenesulfonyloxy group and p-toluenesulfonyloxy group), a carbonyl group (such as alkylcarbonyl groups, e.g., acetyl group and pivaloyl group, and arylcarbonyl groups, e.g., benzoyl group and 3,5-di-t-butyl-4-hydroxybenzoyl group), an oxycarbonyl group (such as alkoxycarbonyl groups, e.g., methoxycarbonyl group, cyclohexyloxycarbonyl group and n-dodecyloxycarbonyl group, aryloxycarbonyl groups, e.g., phenoxycarbonyl group, 2,4-di-t-amylphenoxycarbonyl group and 1-naphthyloxycarbonyl group, and heterocyclic-oxy carbonyl groups, e.g., 2-pyridyloxycarbonyl group and 1-phenylpyrazolyl-5-oxycarbonyl group), a carbamoyl group (such as alkylcarbamoyl groups, e.g., dimethylcarbamoyl group, 4-(2,4-di-t-amylphenoxy)butylamino carbamoyl group, and arylcarbamoyl groups, e.g., phenylcarbamoyl group and 1-naphthylcarbamoyl group), a sulfamoyl group (such as alkylsulfonyl groups, e.g., methanesulfonyl group and trifluoromethanesulfonyl group, and arylsulfonyl groups, e.g., p-toluenesulfonyl group), a sulfamoyl group (such as alkylsulfamoyl groups, e.g., dimethylsulfamoyl group and 4-(2,4-di-t-amylphenoxy)-butylaminosulfonyl group, and arylsulfamoyl groups, e.g., phenylsulfamoyl group), an amino group (such as alkylamino groups, e.g., dimethylamino group, cyclohexylamino group and n-dodecylamino group, and arylamino groups, e.g., anilino group and p-t-octylanilino group, a sulfonylamino group (such as alkylsulfonylamino groups, e.g., methanesulfonylamino group, heptafluoropropanesulfonylamino group and n-hexadecylsulfonylamino group, and arylsulfonylamino groups, e.g., p-toluenesulfonyl group and pentafluorobenzenesulfonylamino group), an acylamino group (such as alkylcarbonylamino groups, e.g., acetylamino group and myristoylamino group, and arylcarbonylamino groups, e.g., benzoylamino group), an alkylthio group (such as methylthio group and t-octylthio group), an arylthio group (such as phenylthio group), and a heterocyclic-thio group (such as 1-phenyltetrazole-5-thio group and 5-methyl-1,3,4-oxadiazole-2-thio group).

$R_1$ represents preferably an alkyl group, more preferably a branched alkyl group and, further preferably a t-butyl group in particular.

The alkyl groups and cycloalkyl groups each represented by $R_2$ in Formula [II] include, for example, those synonymous with the alkyl groups and cycloalkyl groups each represented by $R_1$ in Formula [II]. The aryl groups represented by $R_2$ in Formula [II] include, for example a phenyl group and a 1-naphthyl group. The alkyl, cycloalkyl and aryl groups each represented by $R_2$ may have a substituent. The substituents include, for example, those synonymous with the alkyl groups and cycloalkyl groups each represented by $R_1$ in Formula [I] and those synonymous with the substituents for the alkyl groups and cycloalkyl groups each represented by $R_1$ in Formula [II].

$R_2$ represents preferably an alkyl group, more preferably a non-substituted alkyl group and, further preferably a methyl group in particular.

The groups substitutable onto a benzene ring, which are represented by $R_3$ in Formula [II], include, for example, those synonymous with the groups given as the substituents for the alkyl groups and cycloalkyl groups each represented by $R_2$ in Formula [II].

In Formula [II], m is an integer of 0 to 4, provided when m is pluralized, $R_3$s may be the same with or different from each other. However, m is preferably 1, provided when this is the case, the position for the substitution of $R_3$ is preferably the 5th position of an anilide ring.

In Formula [II], the groups substitutable onto a benzene ring, which are represented by $R_3$, are the substituents represented by the following Formula [V].

$$-NH-X\leftarrow L-Y\rightarrow_n R_4 \qquad \text{Formula [V]}$$

In the above-given Formula [V], X represents carbonyl or sulfonyl group and, preferably, carbonyl group.

In the above-given Formula [V], L represents an alkylene group including, for example, a straight-chained or branched alkylene group, methine group, ethylene group, 2,3-propylene group and 1,2-cyclohexylene group. Among these alkylene groups, the alkylene groups each having 1 to 6 carbon atoms are preferable.

In the above-given Formula [V], Y represents a divalent linkage group including, for example, sulfinyl group, sulfenyl group, sulfonyl group, sulfamoyl group, carbonyl group, carbonyloxy group, carbamoyl group, oxy group, oxycarbonyl group, amino group, acylamino group and sulfonylamino group. Among these linkage groups, sulfonyl group, sulfamoyl group, carbonyloxy group, carbamoyl group, oxy group, oxycarbonyl group and acylamino group are preferable and sulfonyl group, oxycarbonyl group and carbamoyl group are particularly preferable.

In the above-given Formula [V], n is an integer of 0 or 1 and preferably 0.

In the above-given Formula [V], $R_4$ represents an alkyl, cycloalkyl or aryl group. The alkyl, cycloalkyl or aryl group represented by $R_4$ include, for example those synonymous with the alkyl, cycloalkyl or aryl group represented by $R_2$ in Formula [II]. The alkyl, cycloalkyl or aryl group represented by $R_4$ may have each a substituent. The substituents include, for example those synonymous with the groups given as the substituents for the alkyl, cycloalkyl and aryl groups each represented by $R_2$ in Formula [II].

The substituents represented by Formula [V] include, preferably, the substituents represented by the following Formula [VI], [VII] or [VIII].

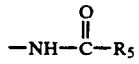

Formula [VI]

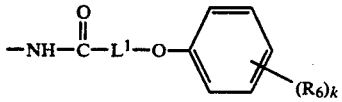

Formula [VII]

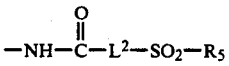

Formula [VIII]

In Formulas [VI] and [VIII], $R_5$ represents an alkyl or cycloalkyl group and includes, for example, those synonymous with the alkyl and cycloalkyl groups each represented by $R_1$ in Formula [II]. The alkyl and cycloalkyl groups represented by $R_5$ may have each a substituent. The substituents include, for example, the groups synonymous with the groups given as the substituents for the alkyl, cycloalkyl and aryl groups each represented by $R_2$ in the foregoing Formula [II]. $R_5$ is particularly preferable to be an alkyl group.

In Formula [VI], $R_5$ represents, preferably, a non-substituted alkyl group, more preferably, a non-substituted straight-chained alkyl group and, further preferably, a non-substituted straight-chained alkyl group having 13 to 21 carbon atoms in particular.

In Formula [VIII], $R_5$ represents preferably a non-substituted alkyl group, more preferably a non-substituted straight-chained alkyl group and, further preferably, a non-substituted straight-chained alkyl group having 8 to 18 carbon atoms in particular.

In Formula [VIII], $R_6$ represents a group substitutable onto a benzene ring and includes, for example, the groups synonymous with the groups given as the substituents for the alkyl, cycloalkyl and aryl groups each represented by $R_2$ in Formula [II].

In Formula [VII], $R_6$ represents preferably a non-substituted alkyl group, more preferably, a non-substituted straight-chained or branched alkyl group and, further preferably, a non-substituted alkyl group having 3 to 12 carbon atoms.

In Formula [VII], k represents an integer of 0 to 5, provided when k is pluralized, $R_6$s may be the same with or the different from each other. However, k is preferably 2.

In Formulas [VII] and [VIII], $L^1$ and $L^2$ represent each an alkylene group and include, for example, the groups synonymous with the groups given as the alkylene groups represented by L in Formula [V].

In Formula [VII], $L^1$ represents, preferably, an alkylene group having 3 to 7 carbon atoms, more preferably, 1,3-propylene group, 1,1-propylene group, 1,1-pentylene group and 1,1-hexylene group and, further preferably, 1,3-propylene group and 1,1-propylene group.

In Formula [VIII], $L^2$ represents, preferably, an alkylene group having 3 to 7 carbon atoms, more preferably, 1,3-propylene group, 2,2-propylene group, 2,3-propylene group and 1,1-propylene group and, further preferably, 1,3- propylene group and 2,3-propylene group in particular.

The substituents represented in Formula [V] include more preferably the substituents represented by Formulas [VI] and [VIII] among the substituents represented by Formulas [VI], [VII] or [VIII] and, further preferably, the substituents represented by Formula [VI] in particular.

In Formula [II], Z represents a group capable of splitting off when coupling to the oxidized products of a developing agent, and includes, for example, the groups represented by the following Formula [IX], [X] or [XI].

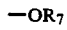

Formula [IX]

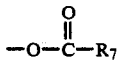

Formula [X]

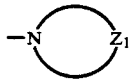

Formula [XI]

In Formulas [IX] and [X], $R_7$ represents an alkyl group, cycloalkyl group, aryl group or heterocyclic group. The alkyl, cycloalkyl and aryl groups each represented by $R_7$ in Formulas [IX] and [X] include, for example, those synonymous with the alkyl, cycloalkyl and aryl groups each represented by $R_7$ in Formula [II]. The heterocyclic groups represented by $R_7$ in Formulas [IX] and [X] include, for example, a 4-pyridyl group and a 2-hexahydropyranyl group. The alkyl, cycloalkyl and aryl groups each represented by $R_7$ each may also have a substituent. The substituents include, for example, those synonymous with the groups given as the substituents for the alkyl, cycloalkyl and aryl groups each represented by $R_7$ in Formula [II]. Among the alkyl, cycloalkyl and aryl groups each represented by $R_7$, aryl groups are preferred.

In Formula [XI], $Z_1$ represents the group consisting of non-metal atoms necessary to form a 5- or 6-membered ring together with a nitrogen atom. The atomic group necessary to form the above-mentioned group consisting of non-metal atoms include, for example, methylene, methine, substituted methine, $>C=O$, $>N-R_8$ (in which $R_8$ represents a hydrogen atom, an alkyl group, an aryl group or a heterocyclic group), $-N=$, $-O-$ and $-S-(O)_u-$ (in which u is an integer of 0 to 2).

The substituents represented by Formula [IX] include, preferably, the substituents represented by the following Formula [XII].

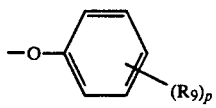

Formula [XII]

In Formula [XII], $R_9$ represents a hydroxyl group or an electron withdrawing group (including, for example, a carboxyl group, oxycarbonyl group, carbonyl group, sulfonyl group, nitro group, cyano group, halogen atom, sulfamoyl group, acylamino group and sulfonylamino group) and p is an integer of 1 to 5, provided when p is pluralized, $R_9$s may be the same or different from each other. In Formula [XII], $R_9$ is preferable to couple at the m- or p-position to an oxygen atom coupling to a coupler residual group.

The substituents represented by Formula [X] include, preferably, the substituents represented by the following Formula [XIII].

Formula [XIII]

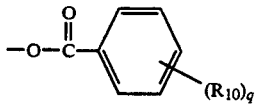

In Formula [XIII], $R_{10}$ represents a group substitutable onto a benzene ring, which include, for example, the groups synonymous with the groups given as the substituents to the alkyl, cycloalkyl and aryl groups each represented by $R_2$ in Formula [II]; and q is an integer of 1 to 5, provided when q is pluralized, $R_{10}$ may be the same with or different from each other.

The substituents represented by Formula [XI] include, preferably, the substituents represented by the following Formulas [XIV], [XV], [XVI], [XVII], [XVIII] and [XIX].

Formula [XIV]

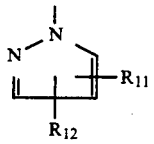

Formula [XV]

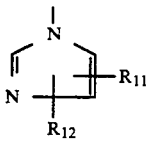

Formula [XVI]

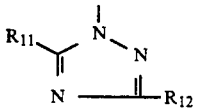

Formula [XVII]

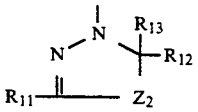

Formula [XVIII]

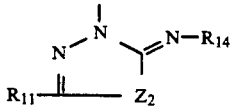

Formula [XIX]

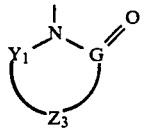

In the above-given Formulas [XIV], [XV], [XVI], [XVII] and [XVIII], $R_{11}$, $R_{12}$ and $R_{13}$ represent each a group substitutable onto an azole ring and include, for example, the groups synonymous with the groups given as the substituents for the alkyl, cycloalkyl and aryl groups each represented by $R_2$ in Formula [II].

In Formula [XVIII], $R_{14}$ represents the groups synonymous with the alkyl, cycloalkyl and aryl groups each represented by $R_7$ in Formulas [IX] and [X], carbonyl group and a sulfonyl group.

In Formulas [XVII] and [XVIII], $Z_2$ represents $>N—R_{15}$ (in which $R_{15}$ represents the groups synonymous with the groups represented by $R_8$ in Formula [XI]), —O— and $—S(O)_v—$ in which v is an integer of 0 to 2.

In Formula [XIX], $Y_1$ represents a group or hetero atom represented by $>N—R_{16}$ (in which $R_{16}$ represents the groups synonymous with the groups represented by $R_8$ in Formula [XI]), —O— and $—S(O)_r—$ (in which r is an integer of 0 to 2), or a carbon atom represented by $>C=O$, $>C(R_{17})(R_{18})$ (in which $R_{17}$ and $R_{18}$ represent each a hydrogen atom or the groups synonymous with the groups given as the substituents for the alkyl, cycloalkyl and aryl groups each represented by $R_2$ in Formula [II]) and $=C(R_{19})—$ (in which $R_{19}$ represents a hydrogen atom or the groups synonymous with the groups given as the substituents for the alkyl, cycloalkyl and aryl groups each represented by $R_2$ in Formula [III]).

In Formula [XIX], $Z_3$ represents the group consisting of non-metal atoms necessary to form a 5- or 6-membered ring together with $—Y_1—N—CO-$. The atomic group necessary to form the group consisting of non-metal atoms include, for example, the atomic groups synonymous with the atomic groups represented by $Z_1$ in Formula [XI].

As for the substituents represented by Z in Formula [XIX], the substituents represented by Formulas [XII] and [XIX] are particularly preferable among the substituents represented by Formulas [XII], [XIII], [XIV], [XV], [XVI], [XVII], [XVIII] and [XIX], and the substituents represented by Formula [XIX] are most preferable.

The two-equivalent yellow couplers represented by Formula [II] may be coupled to any one of substituents so as to form a bis-, tris-, tetrakis-derivative or polymer.

The yellow couplers represented by Formula [II] of the invention can readily be synthesized, by making use of any compounds available on the market as a starting raw material, in any conventionally known methods such as the methods detailed in JP OPI Publication No. 63-123047/1988 and JP Application No. 2-245949/1990.

The typical examples of the elimination group Z in Formula [II] of the invention will be given below.

(A)

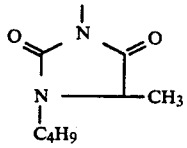

(B)

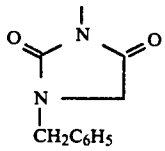

(C)

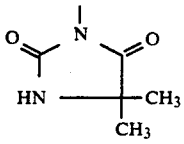

-continued
(D)
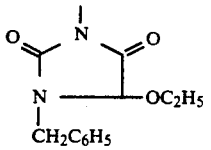
(E)
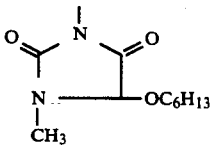
(F)
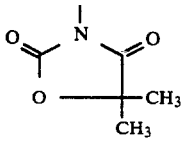
(G)
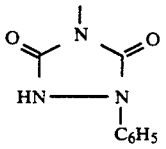
(H)
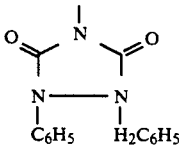
(I)
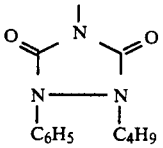
(J)
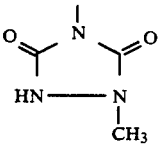
(K)
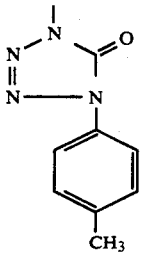
(L)
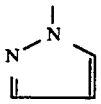
-continued
(M)
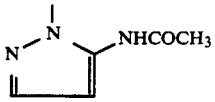
(N)
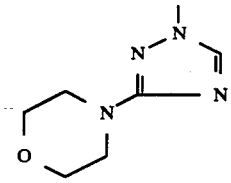
(O)
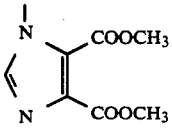
(P)
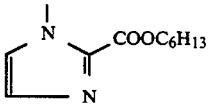
(Q)
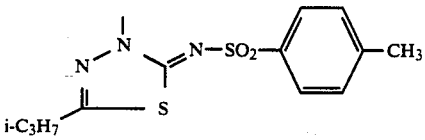
(R)
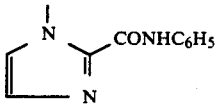
(S)
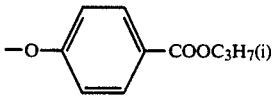
(T)
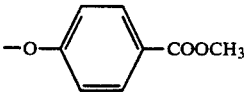
(U)
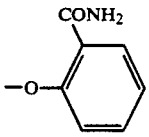
(V)
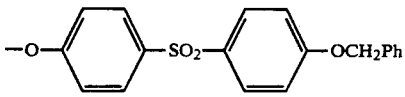
(W)
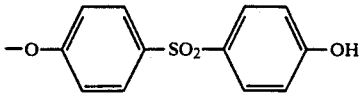

-continued
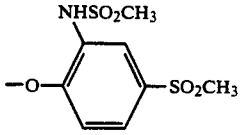
(X)
The typical examples of the substituents $R_3$ in Formula [II] of the invention will be given below.
$-NHCOC_{15}H_{31}(n)$ (a)
$-NHCOC_{17}H_{35}(n)$ (b)
$-NHCOCHC_6H_{13}(n)$ (c)
$\quad\quad\quad -continued

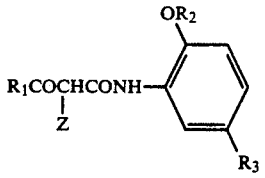

| No. | $R_1$ | $R_2$ | $R_3$ | Z |
|---|---|---|---|---|
| (36) | $(t)C_4H_9$— | 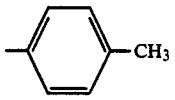 | (c) | (F) |
| (37) | $(t)C_4H_9$— | 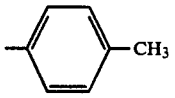 | (f) | (D) |
| (38) | $(t)C_4H_9$— | $-CH_2COOC_{12}H_{25}(n)$ | $-NHSO_2CH_3$ | (X) |
| (39) | $(t)C_4H_9$— | $-CH_2COOC_{12}H_{25}(n)$ | $-NHCOCH_3$ | (V) |

-continued

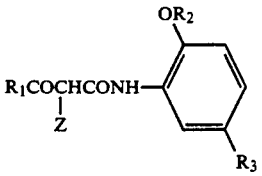

| No. | $R_1$ | $R_2$ | $R_3$ | Z |
|---|---|---|---|---|
| (40) | $(t)C_4H_9$— | $-C_{16}H_{33}$ | $-NHCOCH_3$ | (R) |

The yellow coupler represented by Formula [II] may be added in any amount without any special limitation. However, the couple is added preferably in an amount of 0.05 to 0.8 mol per mol of silver halide.

The magenta dye forming couplers applicable to the invention include, for example, publicly known couplers such as those of the 5-pyrazolone type, pyrazoloazole type and pyrazolobenzimidazole type.

The typical examples of the magenta couplers preferably applicable to the invention will be given below. The invention shall not, however, be limited thereto.

MC-1

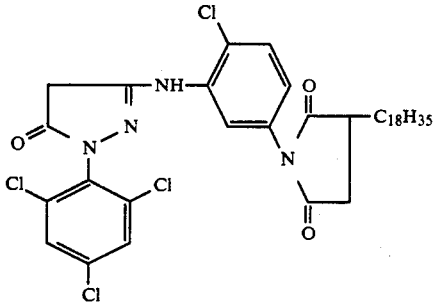

MC-2

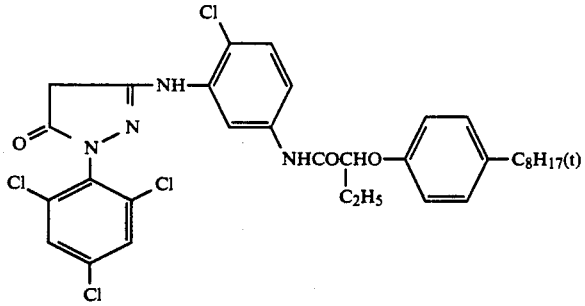

MC-3

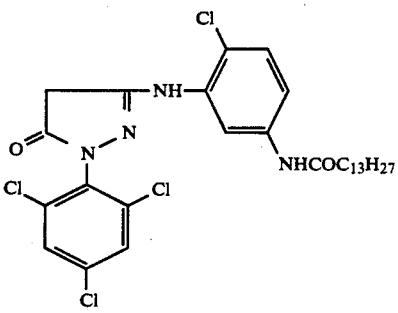

-continued
MC-4
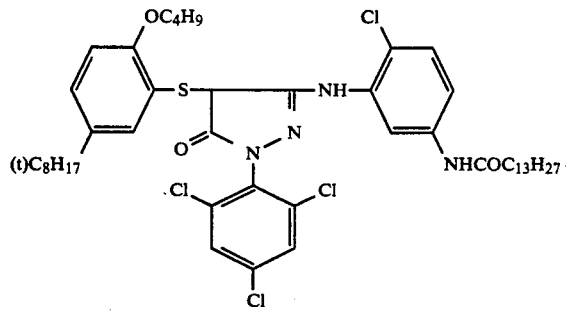
MC-5
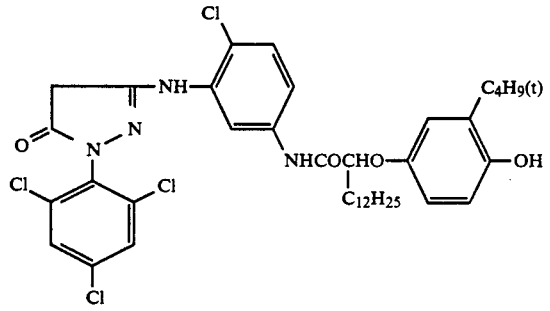
MC-6
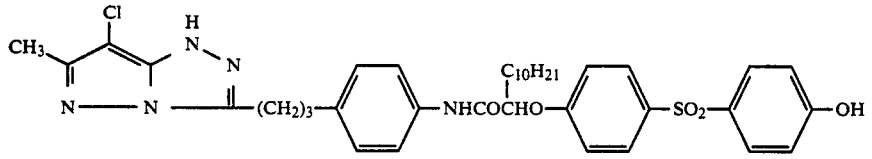
MC-7
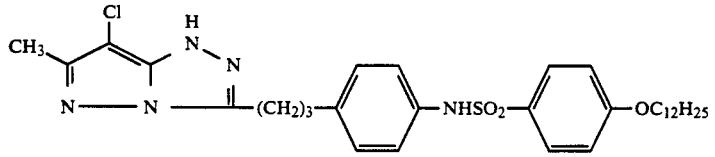
MC-8
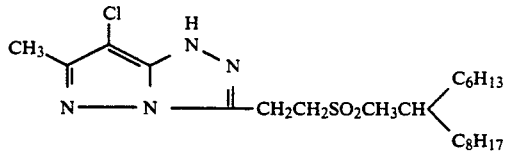
MC-9
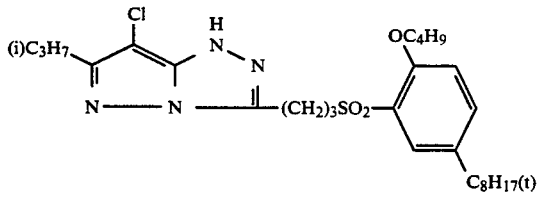
MC-10
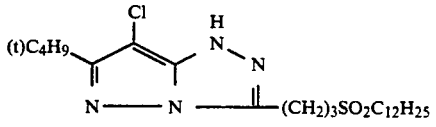

-continued

MC-11

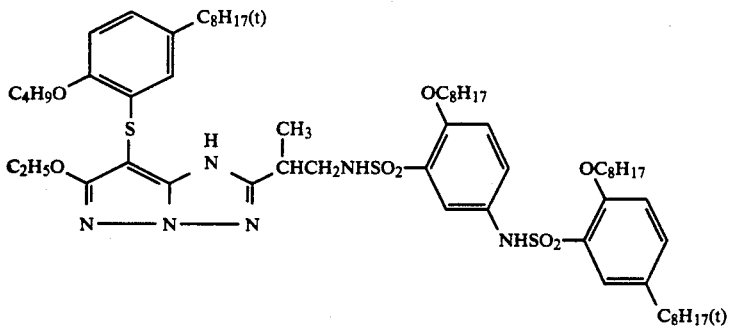

MC-12

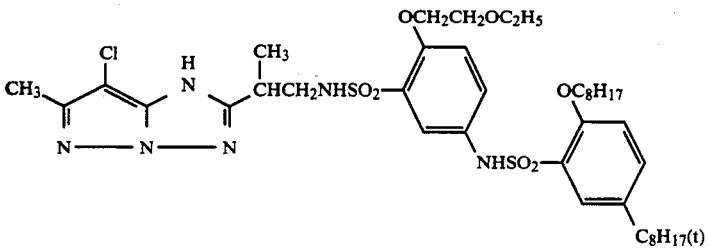

MC-13

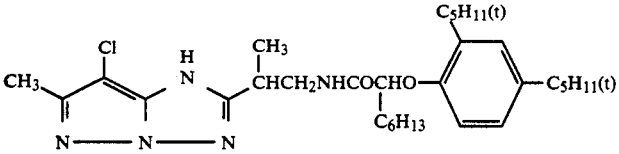

MC-14

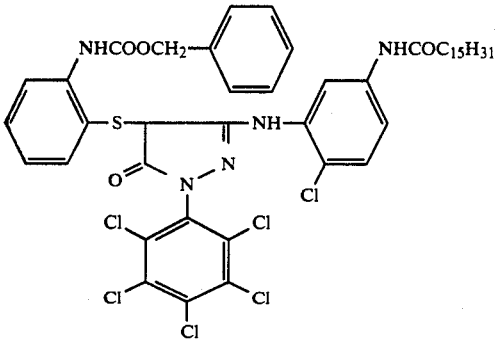

Besides the above-given typical examples, the magenta couplers applicable to the invention further include, for example, the compounds denoted by Nos. 1~4, 6, 8~17, 19~24, 26~43, 45~59, 61~104, 106~121, 123~162 and 164~233 among the compounds given in JP OPI Publications No. 62-166339/1987, in the upper right column on p.18 through the upper right column on p.32; and the compounds denoted by M-1~M-29 given in JP OPI Publication No. 2-100048/1990, pp.5~6.

In the invention, the cyan dye forming couplers preferably applicable to the invention include, for example, those of the naphthol type and the phenol type.

Particularly when the couplers are used in a photographic light sensitive material for direct appreciation, such as color print paper, it is advantageous to use the 2,5-diacylaminophenol type cyan couplers disclosed in U.S. Pat. No. 2,895,826 and JP OPI Publication Nos. 50-112038/1975, 53-109630/1978, 55-163537/1980 and 63-96656/1988; and the phenol type cyan couplers each containing an alkyl group having 2 or more carbon atoms in the 5th position, of which are given in U.S. Pat. Nos. 3,772,002 and 4,443,536, and so forth.

The examples of the former include Exemplified Compounds C-1 through C-25 and so forth given in JP OPI Publication No. 63-96656/1988. The examples of the latter include Exemplified Compounds IV-1 through IV-19 and so forth given in JP OPI Publication No. 1-196048/1989.

The typical examples of the cyan couplers applicable to the invention will be given below. The invention shall not, however, be limited thereto.

CC-1
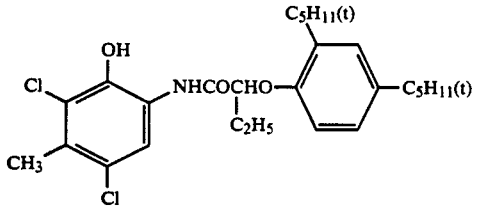
CC-2
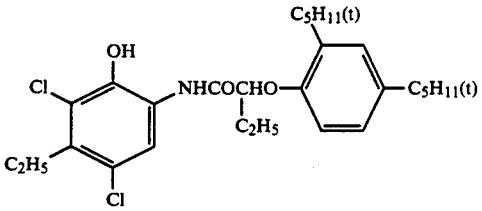
CC-3
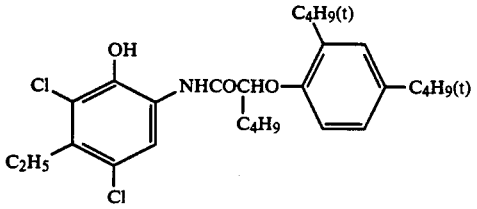
CC-4
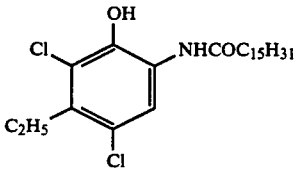
CC-5
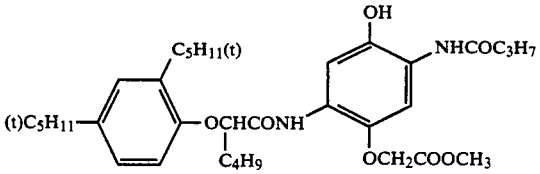
CC-6
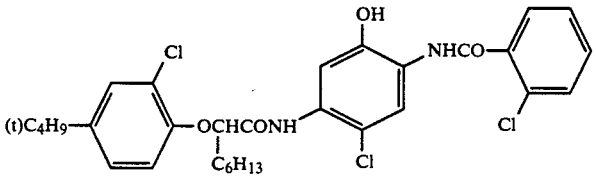
CC-7
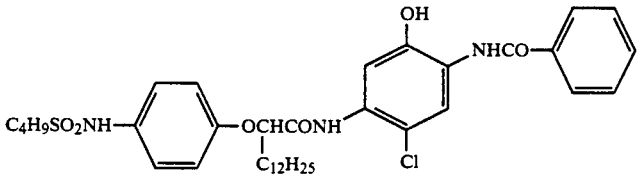
CC-8
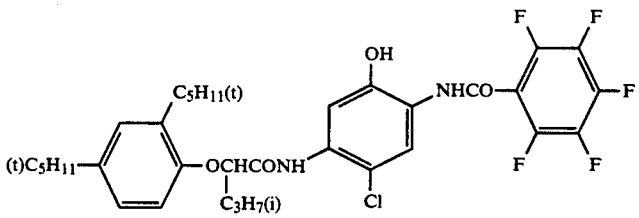
CC-9
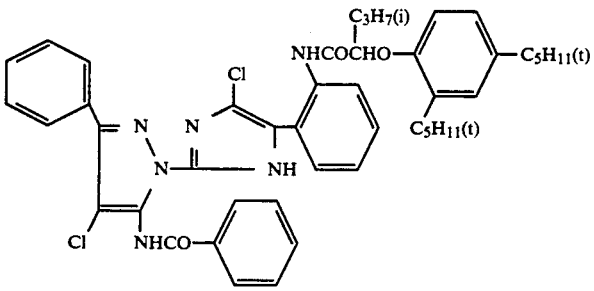

-continued

CC-10

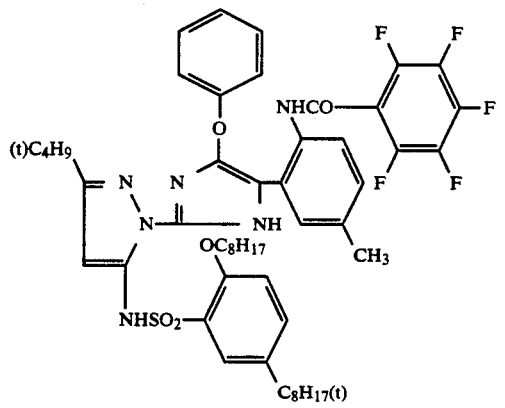

CC-11

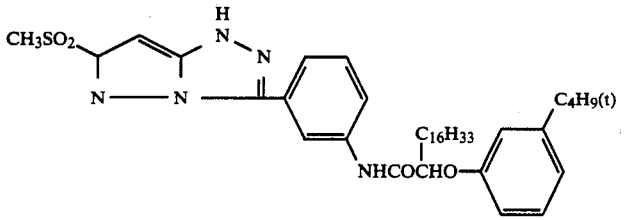

CC-12

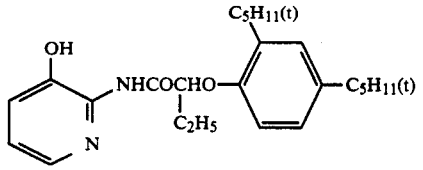

In the silver halide color photographic light sensitive materials of the invention, it is conventional that a compound such as a dye-forming coupler is dissolved in a high-boiling organic solvent having a boiling point of not lower than 150° C. or an water-insoluble polymer and, if required, a low-boiling and/or water-soluble organic solvent in combination and the resulting solution is then emulsified in an aqueous gelatin solution such as a hydrophilic binder by making use of a surfactant. After that, the emulsified dispersion is then added into an objective hydrophilic colloidal layer. It is also allowed to insert a processing step for removing the low-boiling organic solvent from the dispersed solution or at the same time when dispersed.

In the silver halide color photographic light sensitive materials of the invention, a compound represented by Formula [III] is contained in at least one layer of the photographic component layers, namely, a light sensitive silver halide emulsion layer, other light sensitive layers including silver halide emulsion and a non-light-sensitive layer such as an interlayer, a protective layer, a filter layer or an antihalation layer.

Next, the compounds represented by Formula [III] will be detailed. The alkyl groups represented by $R^{13}$, $R^{14}$, $R^{15}$, $R^{16}$ and $R^{17}$ include, for example, the groups such as those of methyl, ethyl, propyl, isopropyl, butyl, t-butyl or the like. The alkyl groups further include those each having a substituent. The substituents include, for example, a hydroxyl group, a sulfo group, a carboxyl group, a halogen atom (such as fluorine, chlorine and bromine), an alkoxy group (such as a methoxy group and an ethoxy group), an aryloxy group (such as a phenyl group, a 4-sulfophenyl group and a 2,5-disulfophenyl group), a cyano group, an alkoxycarbonyl group (such as a methoxycarbonyl group).

The aryl groups represented by $R^{13}$, $R^{14}$, $R^{15}$, $R^{16}$ and $R^{17}$ include, for example, a phenyl group and a naphthyl group. The aryl groups further include those each having a substituent. The aryl groups each having a substituent include, for example, those of 2-methoxyphenyl, 4-nitrophenyl, 3-chlorophenyl, 3-cyanophenyl, 4-hydroxyphenyl, 4-methanesulfonylphenyl, 4-sulfophenyl, 3-sulfophenyl, 2-methyl-4-sulfophenyl, 2-chloro-4-sulfophenyl, 4-chloro-3-sulfophenyl, 2-chloro-5-sulfophenyl, 2-methoxy-5-sulfophenyl, 2-hydroxy-4-sulfophenyl, 2,5-dichloro-4-sulfophenyl, 2,6-diethyl-4-sulfophenyl, 2,5-disulfophenyl, 3,5-disulfophenyl, 2,4-disulfophenyl, 4-phenoxy-3-sulfophenyl, 2-chloro-6-methyl-4-sulfophenyl, 3-carboxy-2-hydroxy-5-sulfophenyl, 4-carboxyphenyl, 2,5-dicarboxyphenyl, 3,5-dicarboxyphenyl, 2,4-dicarboxyphenyl, 3,6-disulfo-α-naphthyl, 8-hydroxy-3,6-disulfo-α-naphthyl, 5-hydroxy-7-sulfo-β-naphthyl and 6,3-disulfo-β-naphthyl.

The alkenyl groups represented by $R^{16}$ and $R^{17}$ include, for example, a vinyl group and allyl group. The alkenyl groups also include those each having a substituent.

The heterocyclic groups represented by $R^{13}$ and $R^{14}$ include, for example, a pyridyl group (such as 2-pyridyl group, 3-pyridyl group, 4-pyridyl group, 5-sulfo-2-pyridyl group, 5-carboxy-2-pyridyl group, 3,5-dichloro-2-pyridyl group, 4,6-dimethyl-2-pyridyl group, 6-hydroxy-2-pyridyl group, 2,3,5,6-tetrafluoro-4-pyridyl group and 3-nitro-2-pyridyl group), an oxazolyl group (such as 5-sulfo-2-benzoxazolyl group, 2-benzoxazolyl group and 2-oxazolyl group), a thiazolyl group (such as 5-sulfo-2-benzothiazolyl group, 2-benzothiazolyl group and 2-thiazolyl group), an imidazolyl group (such as 1-methyl-2-imidazolyl group, 1-methyl-5-sulfo-2-benzimidazolyl group), a furyl group (such as 3-furyl group), a pyrrolyl group (such as 3-pyrrolyl group), a thienyl group (such as 2-thienyl group), a pyradinyl group (such as 2-pyradinyl group), a pyrimidinyl group (such as 2-pyrimidinyl group and 4-chloro-2-pyrimidinyl group), a pyridazinyl group (such as 2-pyridazinyl group), a purinyl group (such as 8-purinyl group), an isoxazolinyl group (such as 3-isoxazolinyl group), a selenazolyl group (such as 5-sulfo-2-selenazolyl group), a sulfolanyl group (such as 3-sulfolanyl group), a piperidinyl group (such as 1-methyl-3-piperidinyl group), a pyrazolyl group (such as 2-pyrazolyl group) and a tetrazolyl group (such as 1-tetrazolyl group).

The cycloalkyl groups represented by $R^{13}$ and $R^{14}$ include, for example, a cyclopentyl group and a cyclohexyl group, and they also include those each having a substituent.

The methine groups represented by $L_1$ through $L_3$ include those each having a substituent (such as an alkyl group and an aryl group). The 5- or 6-membered rings formed together with a nitrogen atom upon coupling to $R^{16}$ or $R^{17}$ include, for example, a pyrrole ring, an imidazole ring, a pyrazole ring, an isoindole ring, an indole ring, an indazole ring, a purine ring, a carbazole ring, a carboline ring, a pyrimidine ring, a phenothiazine ring, a phenoxazine ring, a triazole ring, a benzimidazole ring and a benztriazole ring. Also, the above-given rings are each allowed to have a substituent.

The water-soluble groups, which at least one of $R^{11}$, $R^{12}$, $R^{13}$ and $R^{14}$ has, include, for example, a sulfo group, a carboxyl group and a sulforanyl group. The water-soluble groups also include the salts of sodium, potassium or the like.

The typical examples of the dyes represented by the foregoing Formula [III] will be given below. However, the invention shall not be limited thereto.

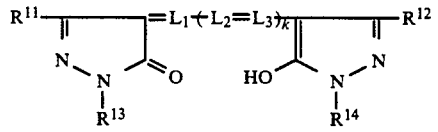

| No. | $=L_1-(L_2=L_3)_k-$ | $R^{11}$, $R^{12}$ | $R^{13}$, $R^{14}$ |
|---|---|---|---|
| III-1 | =CH—CH=CH—CH=CH— | —CN | 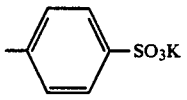 |
| III-2 | =CH—CH=CH—CH=CH— | —CN | 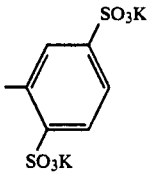 |
| III-3 | =CH—CH=CH—CH=CH— | —CN | 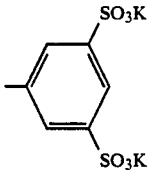 |
| III-4 | =CH—CH=CH—CH=CH— | —CN | 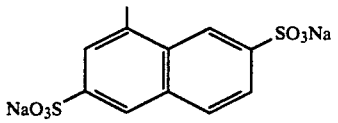 |
| III-5 | 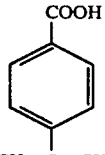 =CH—CH=C—CH=CH— | —CN | 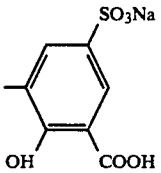 |
| III-6 | =CH—CH=CH—CH=CH— | $-COCH_3$ | 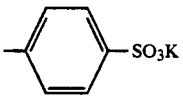 |

-continued
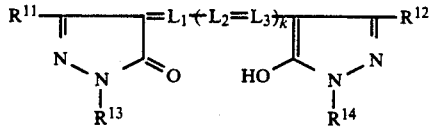
| No. | $=L_1-(L_2=L_3)_k-$ | $R^{11}$, $R^{12}$ | $R^{13}$, $R^{14}$ |
|---|---|---|---|
| III-7 | =CH—CH=CH—CH=CH— | —$COCH_3$ | 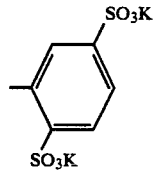 |
| III-8 | =CH—CH=CH—CH=CH— | —$COCH_3$ | 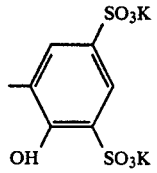 |
| III-9 | =CH—CH=CH—CH=CH— | —$COC_2H_5$ | 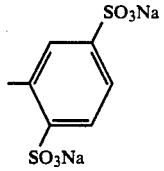 |
| III-10 | =CH—CH=CH—CH=CH— | —$COCH_3$ | —$CH_2CH_2SO_3K$ |
| III-11 | =CH—CH=CH—CH=CH— | 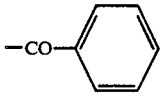 | 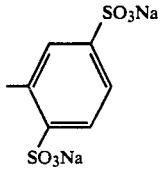 |
| III-12 | =CH—CH=CH—CH=CH— | 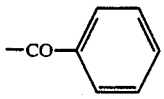 | —$(CH_2)_3SO_3Na$ |
| III-13 | =CH—CH=CH—CH=CH— | —$COOC_2H_5$ | 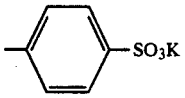 |
| III-14 | =CH—CH=CH—CH=CH— | —$COOC_2H_5$ | 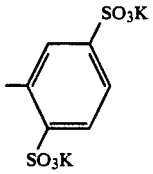 |
| III-15 | =CH—CH=CH—CH=CH— | 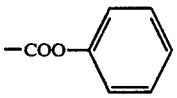 | 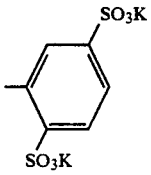 |

-continued
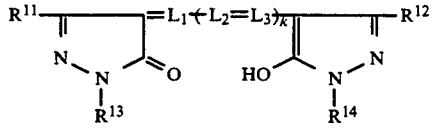
| No. | $=L_1-(L_2=L_3)_k-$ | $R^{11}$, $R^{12}$ | $R^{13}$, $R^{14}$ |
|---|---|---|---|
| III-16 | =CH—CH=CH—CH=CH— | 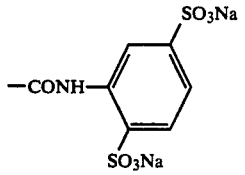 | —$CH_3$ |
| III-17 | =CH—CH=CH—CH=CH— | 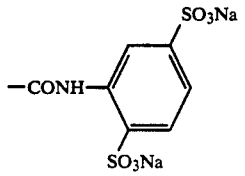 | —$CH_2CH_2OH$ |
| III-18 | =CH—CH=CH—CH=CH— | 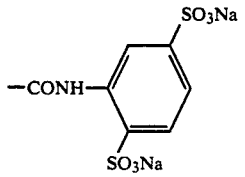 | 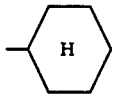 |
| III-19 | =CH—CH=CH—CH=CH— | 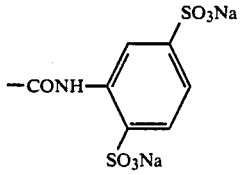 | 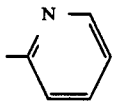 |
| III-20 | =CH—CH=CH—CH=CH— | 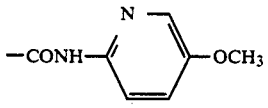 | 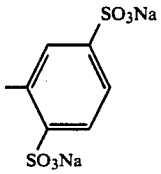 |
| III-21 | =CH—CH=CH—CH=CH— | 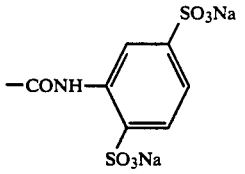 | —$CH_2CH_2COOH$ |
| III-22 | =CH—CH=CH—CH=CH— | 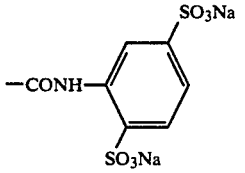 | 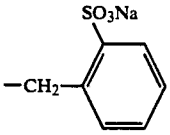 |
| III-23 | =CH—CH=CH—CH=CH— | —$CONHCH_2CH_2OH$ | 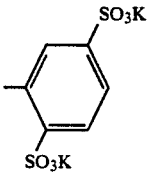 |

-continued
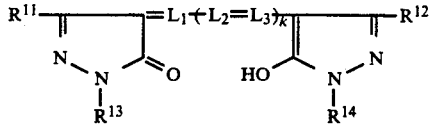
| No. | $=L_1-(L_2=L_3)_k-$ | $R^{11}$, $R^{12}$ | $R^{13}$, $R^{14}$ |
|---|---|---|---|
| III-24 | =CH—CH=CH—CH=CH— | —CONHCH$_2$CH$_2$OH | 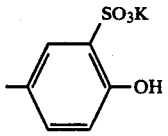 |
| III-25 | =CH—CH=CH—CH=CH— | —CONHCH$_2$CH$_2$OH | 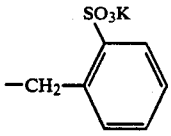 |
| III-26 | =CH—CH=CH—CH=CH— | —CONHCH$_2$CH$_2$OH | 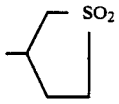 |
| III-27 | =CH—CH=CH—CH=CH— | 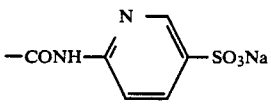 | 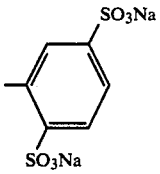 |
| III-28 | =CH—CH=CH—CH=CH— | 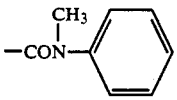 | 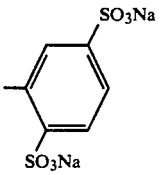 |
| III-29 | =CH—CH=CH—CH=CH— | 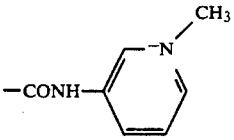 | 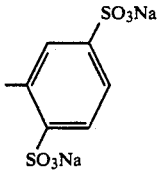 |
| III-30 | =CH—CH=CH—CH=CH— | 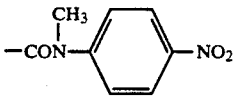 | 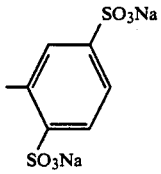 |
| III-31 | 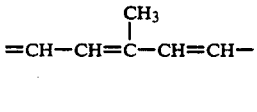 | 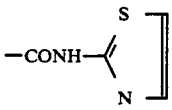 | —CH$_2$CH$_2$SO$_3$Na |
| III-32 | 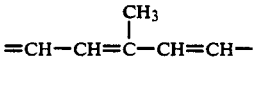 | 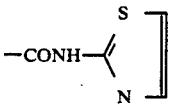 | 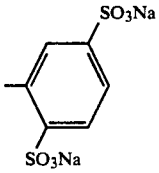 |

-continued
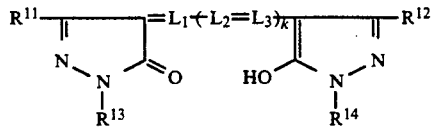
| No. | $=L_1-(L_2=L_3)_k-$ | $R^{11}$, $R^{12}$ | $R^{13}$, $R^{14}$ |
|---|---|---|---|
| III-33 | =CH—CH=CH—CH=CH— | 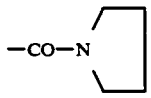 | 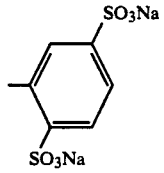 |
| III-34 | =CH—CH=CH—CH=CH— | 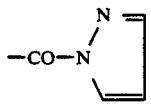 | 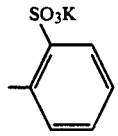 |
| III-35 | =CH—CH=CH—CH=CH— | 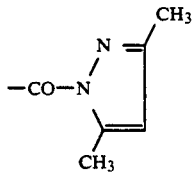 | 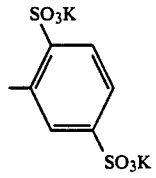 |
| III-36 | =CH—CH=CH—CH=CH— | 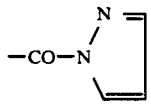 | 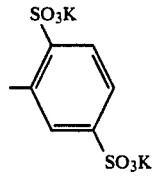 |
| III-37 | =CH—CH=CH—CH=CH— | 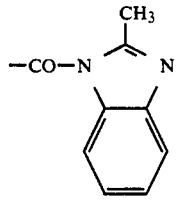 | 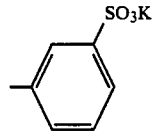 |
| III-38 | =CH—CH=CH—CH=CH— | 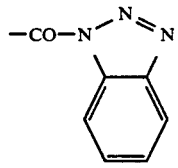 | 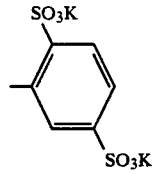 |
| III-39 | =CH—CH=CH—CH=CH— | 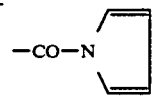 | 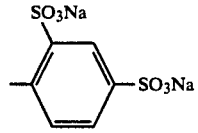 |
| III-40 | =CH—CH=CH—CH=CH— | 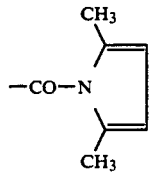 | 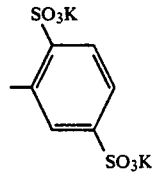 |

-continued
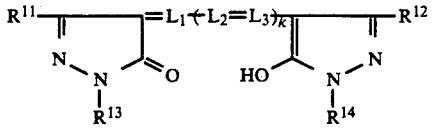
| No. | $=L_1-(L_2=L_3)_k-$ | $R^{11}$, $R^{12}$ | $R^{13}$, $R^{14}$ |
|---|---|---|---|
| III-41 | =CH—CH=CH—CH=CH— | 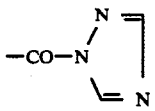 | 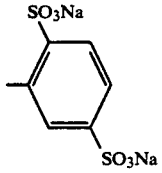 |
| III-42 | =CH—CH=CH—CH=CH— | 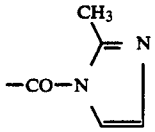 | 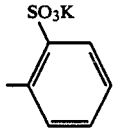 |
| III-43 | =CH—CH=CH—CH=CH— | 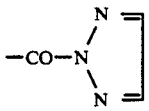 | 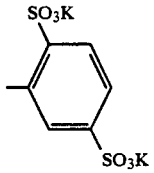 |
| III-44 | =CH—CH=CH—CH=CH— | 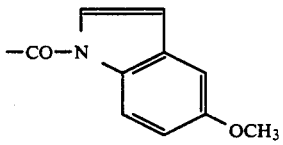 | 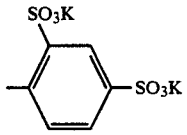 |
| III-45 | =CH—CH=CH—CH=CH— | 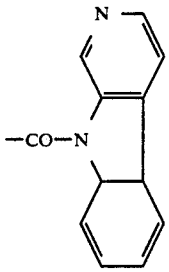 | 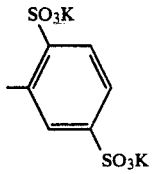 |
| III-46 | =CH—CH=CH—CH=CH— | 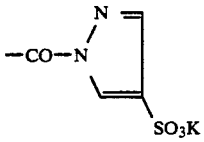 | 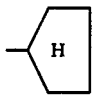 |
| III-47 | =CH—CH=CH—CH=CH— | 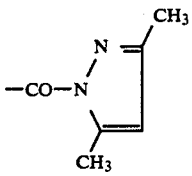 | 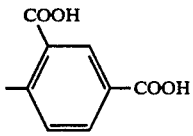 |
| III-48 | =CH—CH=CH—CH=CH— | 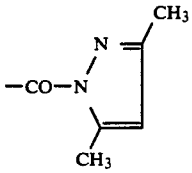 | $-CH_2CH_2SO_3K$ |

-continued
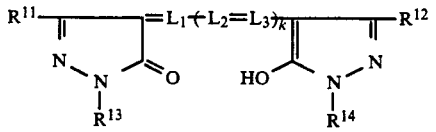
| No. | $=L_1-(L_2=L_3)_k-$ | $R^{11}$, $R^{12}$ | $R^{13}$, $R^{14}$ |
|---|---|---|---|
| III-49 | =CH—CH=CH—CH=CH— | 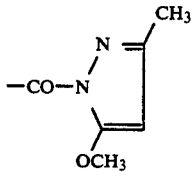 | 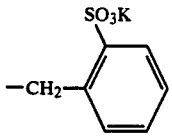 |
| III-50 | =CH—CH=CH—CH=CH— | 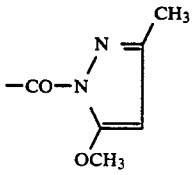 | 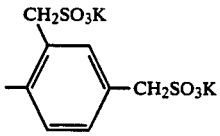 |
| III-51 | =CH—CH=CH—CH=CH— | 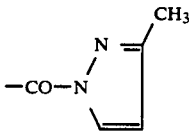 | 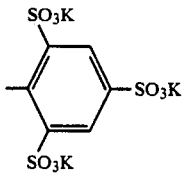 |
| III-52 | =CH—CH=CH—CH=CH— | 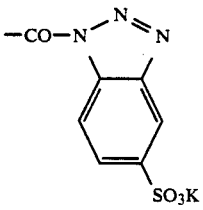 | —H |
| III-53 | =CH—CH=CH—CH=CH— | 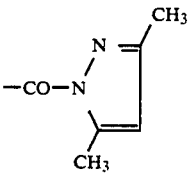 | 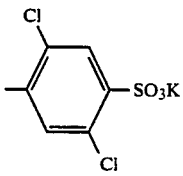 |
| III-54 | =CH—CH=CH— | —CN | 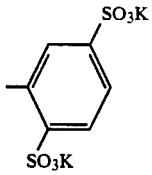 |
| III-55 | =CH—CH=CH— | —$COCH_3$ | 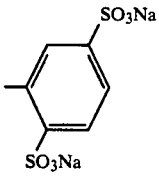 |
| III-56 | =CH—CH=CH— | 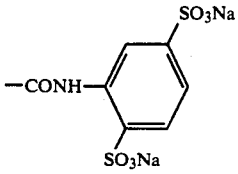 | —$CH_3$ |

-continued
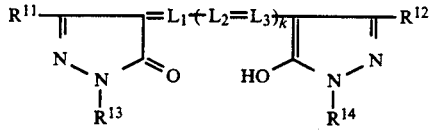
| No. | $=L_1-(L_2=L_3)_k-$ | $R^{11}$, $R^{12}$ | $R^{13}$, $R^{14}$ |
|---|---|---|---|
| III-57 | =CH—CH=CH— | $-COOC_2H_5$ | 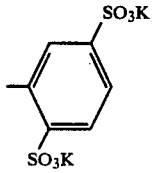 |
| III-58 | =CH—CH=CH— | 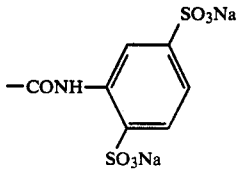 | 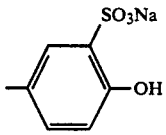 |
| III-59 | =CH—CH=CH— | 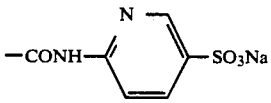 | 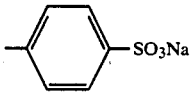 |
| III-60 | =CH—CH=CH— | $-CONHCH_2CH_2OH$ | 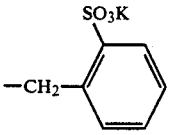 |
| III-61 | =CH—CH=CH— | 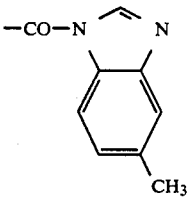 | 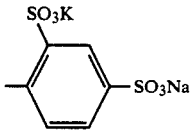 |
| III-62 | =CH—CH=CH— | 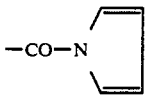 | 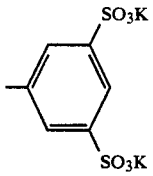 |
| III-63 | =CH—CH=CH— | 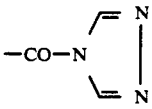 | 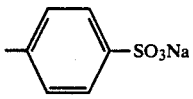 |
| III-64 | =CH—CH=CH— | 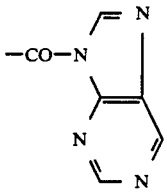 | 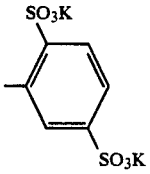 |
| III-65 | =CH— | —CN | 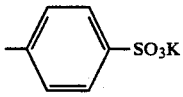 |

-continued

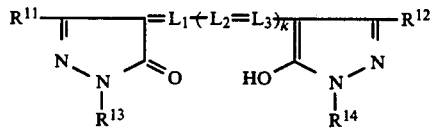

| No. | $=L_1-(L_2=L_3)_k-$ | $R^{11}$, $R^{12}$ | $R^{13}$, $R^{14}$ |
|---|---|---|---|
| III-66 | =CH— | 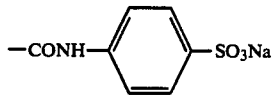 | $-CH_3$ |
| III-67 | =CH— | 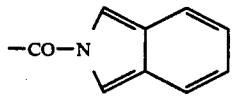 | 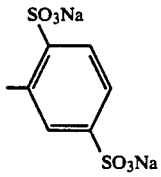 |
| III-68 | =CH— | 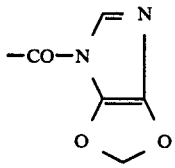 | 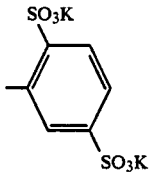 |

The dyes of the invention may be contained in any layers coated on a support, such as silver halide emulsion layers and other hydrophilic colloidal layers. It is, however, desired that the dyes are contained in a layer adjacent to a red-sensitive emulsion layer. Provided when such a dye is diffused into other layer, it is possible to obtain the same effects as those obtained by adding them in the adjacent layer, even if the dyes are added into any other interlayers or protective layers than the adjacent layer.

There is no special limitation to the amounts of the dyes of the invention to be added. However, they are so used as to be coated in an amount within the range of, preferably, 1 to 200 mg/m$^2$ of a photographic material and, more preferably, 3 to 100 mg/m$^2$.

The dyes of the invention, which are represented by Formula [III], may be used independently or in combination. It is further allowed to use them in combination with any dyes other than those of the invention.

Two or more kinds of dyes which are made combination use may be added at the same time or at the different points of time. They may also be added in the form of the separate solutions (or the dispersed solutions) or may be added upon mixing them up in advance.

Generally, the dyes of the invention can be contained in a photographic emulsion layer or other hydrophilic colloidal layer in the following procedures. the dyes or the organic or inorganic salts thereof are dissolved in an aqueous solution or an organic solvent (such as alcohols, glycols, cellosolves, dimethyl formamide, dibutyl phthalate and tricresyl phosphate) and, if required, after the resulting solution is emulsified to be dispersed and is then added into a coating solution, the resulting coating solution is coated, so that the dyes of the invention can be contained in the light sensitive material.

Further for preventing any mold from producing in the emulsions of the invention, an antimold is preferable to be contained therein. A variety of antimolds have so far been studied to put them into practical use.

However, when making use of such an antimold as mentioned above in an effective amount, it was found that the sensitivity is deteriorated while a coating solution being allowed to stand. This phenomenon is remarkably produced particularly when making use of a high chloride-containing silver halide emulsion and a serious trouble is produced when preparing a silver halide photographic light sensitive material containing a rapid processable and highly silver chloride-containing emulsion, so that the improvements have been desired for. Particularly in the case of a multilayered color light sensitive material, there is produced a trouble for example that any desired characteristics cannot be displayed because the color balance is lost when the sensitivities and gradations are varied with each other among the layers. Or, in the case of a light sensitive material for color printing use, there is produced a trouble for example that, when a printing is carried out by a photofinisher under an exposure condition set in advance, the print yield is seriously lowered because the characteristics cannot be displayed uniformly in a printing lot and the printed results from each roll also become different.

The present inventors have devoted themselves to study repeatedly on the troubles of a sensitivity variation produced when a coating solution being allowed to stand, which have been made problematical when adding the compounds represented by the following Formula [XX], [XXI], [XXII] or [XXIII] in such an amount as is capable of preventing a mold production. Resultingly, the inventors have discovered that, when making combination use of Compound [I] of the invention together with the above-mentioned compounds, the sensitivity variation produced on standing can remarkably be improved, and that a coating trouble induced by a mold production can be remedied without spoiling any effects of the compounds.

Formula [XX]

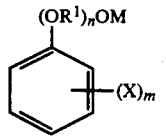

wherein $R^1$ represents a lower alkylene group; M represents a hydrogen atom, an alkali metal or an alkyl group; X represents a halogen atom, an alkyl group, a cycloalkyl group, an aryl group, a carboxyl group, an amino group, a hydroxyl group, a sulfo group, a nitro group or an alkoxycarbonyl group; m is an integer of 1 to 5; and n is an integer of 0 or 1.

Formula [XXI]

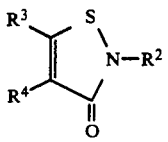

wherein $R^2$ represents a hydrogen atom, an alkyl group, a cycloalkyl group, an alkenyl group, an aralkyl group, an aryl group, an alkoxy group, —CONHR (in which R represents a hydrogen atom, an alkyl group, an aryl group, an alkylthio group, an arylthio group, an alkylsulfonyl group or an arylsulfonyl group) or a heterocyclic group; and $R^3$ and $R^4$ represent each a hydrogen atom, a halogen atom, an alkyl group, a cycloalkyl group, an aryl group, a heterocyclic group, a cyano group, an alkylthio group, an arylthio group, an alkylsulfoxide group, an alkylsulfonyl group or an alkylsulfinyl group, provided that $R^3$ and $R^4$ may also be so coupled to each other as to form a benzene ring which may have a substituent.

Formula [XXII]

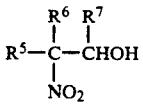

wherein $R^5$ and $R^6$ represent each a hydrogen atom, a halogen atom, a lower alkyl group having 1 to 5 carbon atoms or a hydroxymethyl group; and $R^7$ represents a hydrogen atom or a lower alkyl group having 1 to 5 carbon atoms.

Formula [XXIII]

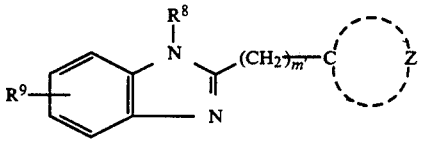

wherein $R^8$ represents a hydrogen atom, an alkyl group or an aryl group; $R^9$ represents a hydrogen atom, an alkyl group, an aryl group, a nitro group, a carboxyl group, a sulfo group, a sulfamoyl group, a hydroxyl group, a halogen atom, an alkoxy group or a thiazolyl group; Z represents the group consisting of atoms capable of forming a thiazole ring; and m' is an integer of 0 or 1.

In Formula [XX], the lower alkylene groups represented by $R^1$ include, for example, a methylene group, an ethylene group and a propylene group; the alkali metals represented by M include, for example, sodium, potassium or the like; the halogen atoms represented by X include, for example, chlorine atom, bromine atom, iodine atom or the like; The alkyl groups preferably represented by X include, for example, a straight-chained or branched alkyl group having 1 to 8 carbon atoms; The cycloalkyl groups preferably represented by X include, for example, a cycloalkyl group having 4 to 8 carbon atoms; the aryl groups include, for example, a phenyl group, a naphthyl group or the like; and the alkoxycarbonyl groups preferably have each 1 to 5 carbon atoms.

Each of the above-given groups may also be substituted with an alkyl group having 1 to 4 carbon atoms, a halogen atom, a hydroxyl group, a sulfo group, a nitro group, a cyano group, a carboxyl group, a phenyl group or the like.

In Formula [XXI], the alkyl and alkenyl groups represented by $R^2$ have each, preferably, 1 to 36 carbon atoms and, more preferably, 1 to 18 carbon atoms; the cycloalkyl groups have each, preferably,3 to 12 and, more preferably, 3 to 6 carbon atoms, provided that each of these alkyl, alkenyl, cycloalkyl, aralkyl, aryl and heterocyclic groups may also have a substituent. The substituents thereto may be selected from the group consisting of, for example, a halogen atom and a group of nitro, cyano, thiocyano, aryl, alkoxy, aryloxy, carboxyl, sulfoxy, alkylcarbonyl, alkoxycarbonyl, aryloxycarbonyl, sulfo, acyloxy, sulfamoyl, carbamoyl, acylamino, diacylamino, ureido, thioureido, urethane, thiourethane, sulfonamido, arylsulfonyloxy, alkylsulfonyloxy, arylsulfonyl, alkylsulfonyl, arylthio, alkylthio, alkylsulfinyl, arylsulfinyl, alkylamino, dialkylamino, anilino, hydroxyl, mercapto, heterocyclic and so forth.

The alkyl groups each represented by $R^3$ and $R^4$ have, preferably, 1 to 18 carbon atoms and, more preferably, 1 to 9 carbon atoms; and the cycloalkyl groups each represented thereby have, preferably, 3 to 12 carbon atoms and, more preferably, 3 to 6 carbon atoms, provided that the cycloalkyl and aryl groups may also have each a substituent. The substituents thereto include, for example, a halogen atom, a nitro group, a sulfo group, an aryl group, a hydroxyl group and so forth. When $R^3$ and $R^4$ can form a benzene ring by each other, the groups substituted to the benzene ring include, for example, a halogen atom, an alkyl group, an alkoxy group, a cyano group, a nitro group and so forth.

In Formula [XXII], the lower alkyl groups each having 1 to 5 carbon atoms, which are represented by $R^5$, $R^6$ and $R^7$ may also have each a substituent.

In Formula [XXIII], $R^8$ represents preferably a hydrogen atom or an alkyl group having 1 to 3 carbon atoms; $R^9$ represents preferably a nitro group, a sulfo group, a halogen atom, a hydroxyl group; and m' is preferably an integer of 1.

The typical examples of the compounds represented by the foregoing Formulas (hereinafter called the compounds of the invention) will now be given below.

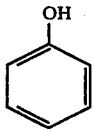

1

-continued
2
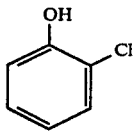
3
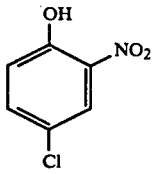
4
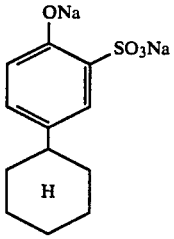
5
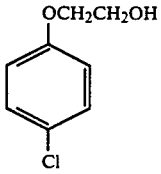
6
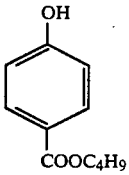
7
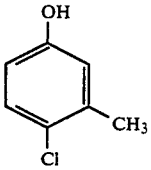
8
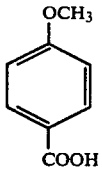
9
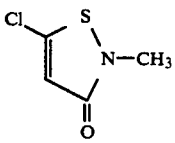
10
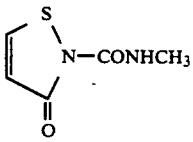
-continued
11
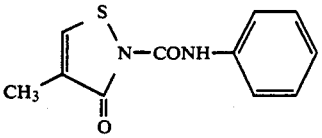
12
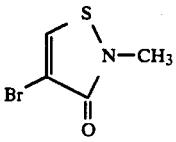
13
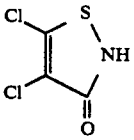
14
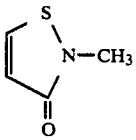
15
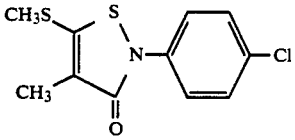
16
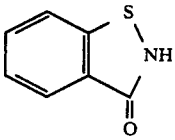
17
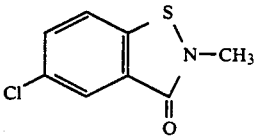
18
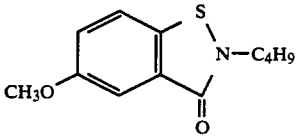
19
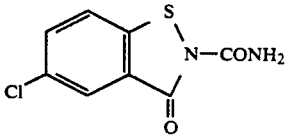
20
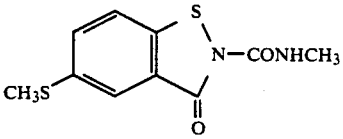

-continued

21

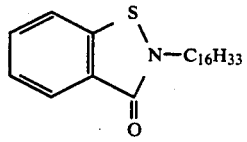

22

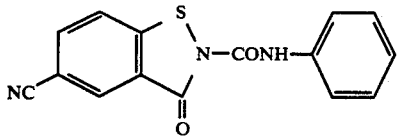

23

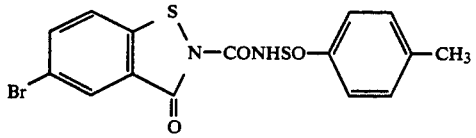

24

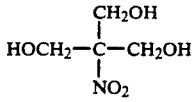

25

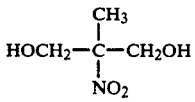

26

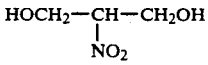

27

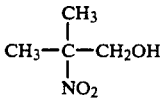

28

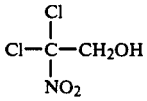

29

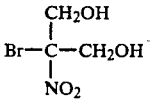

30

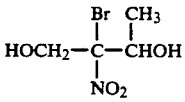

31

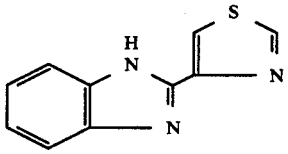

32

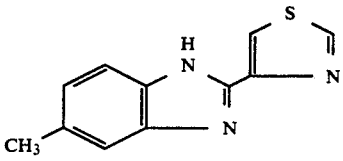

-continued

33

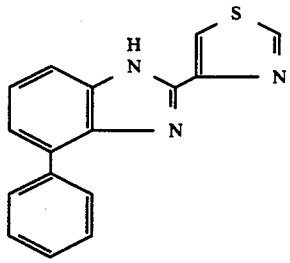

34

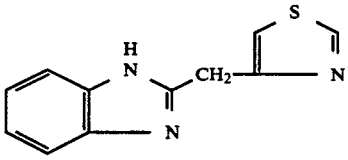

35

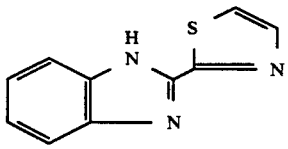

36

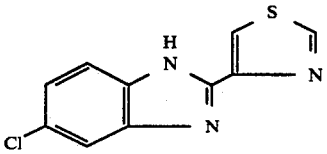

37

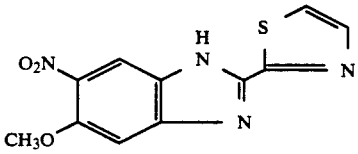

In the invention, one or more kinds of the above-mentioned compounds can be selected out of the above-given exemplified compounds. These compounds are generally known and are commecially available from I.C.I. Japan Ltd., Dai-Nippon Ink Industrial Co., Rohm and Haas, Japan, Ltd., San-Ai Peteroleum Co. and so forth.

There is no special limitation to the amounts of these compounds to be added. However, it is preferable to add them in an amount within the range of $1\times10^{-4}$ to $1\times10^{-2}$ g/m$^2$ of photographic material, and they may be added to either one of a silver halide emulsion layer and a non-emulsion layer. There is also no special limitation to the methods for adding them.

The binders applicable to the silver halide color photographic light sensitive materials of the invention, gelatin is preferably be used for.

Gelatin applicable to the light sensitive materials of the invention may be either the lime-processed or the acid-processed. Gelatin made of any one of cattle bone, cattle hide or pig skin. Among them, a lime-processed gelatin made of cattle bone is preferably used.

In the light sensitive materials of the invention, the photographic emulsion layers and other hydrophilic colloidal layers are hardened by cross-linking the binders (or the protective colloids) and then by making independent or combination use of hardeners for enhancing the layer hardness.

In the light sensitive materials of the invention, the hydrophilic colloidal layers such as a protective layer and an interlayer are allowed to contain a UV absorbent for preventing any fogs produced by a discharge caused by a charge generated by a friction or the like and for preventing any image quality deterioration caused by UV rays.

Besides the above-mentioned additives, a color-stain preventer, an image stabilizer, a plasticizer, a polymer latex, a formalin scavenger, a development accelerator, a development retardant, a fluorescent whitening agent, a matting agent, a lubricant, an antistatic agent or a surfactant may also optionally be used in the light sensitive materials of the invention.

In processing the light sensitive materials of the invention, the color developing agents applicable to the color developers used therein include any known ones being widely used in various color photographic processes.

The developing agents include, for example, an aminophenol type derivative and a p-phenylenediamine type derivative. These compounds are generally used in the form of a salt such as a hydrochloride or sulfate. These compounds are generally used in a concentration within the range of 0.1 to 30 g per liter of a color developer used and, preferably, about 1 g to about 15 g per liter of a color developer used.

The particularly preferable primary aromatic amine type color developing agents include an N,N-dialkyl-p-phenylenediamine type compound. The alkyl and phenyl groups thereof may also optionally be substituted.

Besides the above-mentioned primary aromatic amine type color developing agents, any known compounds for the components of developers may also be added to the color developers applicable to process the light sensitive materials of the invention. For example, it is allowed to add an alkalizer such as sodium hydroxide, sodium carbonate and potassium carbonate, an alkali-metal sulfite, an alkali-metal bisulfite, an alkali-metal thiocyanate, an alkali-metal halide, benzyl alcohol, a water softener, a thickener and so forth.

The above-mentioned color developers are to have usually a pH of not lower than 7 and, most generally, a pH within the range of about 10 to 13.

The color developing temperature is usually not lower than 15° C. and, generally within the range of 20° C. to 50° C. For carrying out a rapid development, the temperature is preferably set to be not lower than 30° C. The developing time is preferably within the range of 10 seconds to 60 seconds and more preferably within the range of 20 seconds to 45 seconds.

After completing a color development, the light sensitive materials of the invention are bleached and fixed. The bleaching and fixing treatments may be made at the same time.

After completing a fixing treatment, a washing treatment is usually made. In order to substitute for the washing treatment, a stabilizing treatment may be made and the both treatments may also be made in combination. The stabilizing solutions applicable to the stabilizing treatment are allowed to contain a pH controller, a chelating agent, and so forth.

EXAMPLES

The invention will now be detailed with reference to the following examples. It is, however, to be understood that the embodiments of the invention shall not be limited thereto.

EXAMPLE-1

Multilayered silver halide color photographic light sensitive material sample No. 1-1 was prepared in the following manner. Polyethylene was laminated on one side of a paper-made support and polyethylene containing titanium oxide was laminated on the other side thereof and, on the resulting paper support, each of the layers having the following compositions was coated on the side laminated with the titanium oxide containing polyethylene. The coating solutions were each prepared as follows.

Coating Solution for Layer 1

26.7 g of yellow coupler (YC-1), 10.0 g of dye-image stabilizer (ST-1), 6.67 g of dye-image stabilizer (ST-2), 0.67 g of antistaining agent (HQ-1) and 6.67 g of high boiling organic solvent (DNP) were dissolved in sixty (60) cc of ethyl acetate. The resulting solution was emulsified to be dispersed in 220 cc of an aqueous 10% gelatin solution containing 7 cc of a 20% surfactant (SU-1) solution by making use of an ultrasonic homogenizer, so that a yellow coupler dispersion solution was prepared. The resulting dispersion solution was mixed with a blue-sensitive silver halide emulsion (containing 10 g of silver) in the following conditions, so that the coating solution for Layer 1 was prepared.

| Layer | Composition | Amount added (in g/m$^2$) |
|---|---|---|
| Layer 7 (Protective layer) | Gelatin | 1.00 |
| | Antistaining agent (HQ-2) | 0.002 |
| | Antistaining agent (HQ-3) | 0.002 |
| | Antistaining agent (HQ-4) | 0.004 |
| | Antistaining agent (HQ-5) | 0.02 |
| | DIDP | 0.005 |
| | Antimold (F-1) | 0.002 |
| Layer 6 (UV absorbing layer) | Gelatin | 0.40 |
| | UV absorbent (UV-1) | 0.10 |
| | UV absorbent (UV-2) | 0.04 |
| | UV absorbent (UV-3) | 0.16 |
| | Antistaining agent (HQ-5) | 0.04 |
| | DNP | 0.20 |
| | PVP | 0.03 |
| Layer 5 (Red-sensitive) layer) | Gelatin | 1.30 |
| | Red-sensitive silver chlorobromide emulsion (Em-R) | 0.21 |
| | Cyan coupler (CC-8) | 0.17 |
| | Cyan coupler (CC-2) | 0.25 |
| | Dye-image stabilizer (ST-1) | 0.20 |
| | Antistaining agent (HQ-1) | 0.01 |
| | HBS-1 | 0.20 |
| | DOP | 0.20 |
| Layer 4 (UV absorbing layer) | Gelatin | 0.94 |
| | UV absorbent (UV-1) | 0.28 |
| | UV absorbent (UV-2) | 0.09 |
| | UV absorbent (UV-3) | 0.38 |
| | Antistaining agent (HQ-5) | 0.10 |
| | DNP | 0.40 |
| | Dye (See Table 3) | |
| Layer 3 (Green-sensitive layer) | Gelatin | 1.40 |
| | Green-sensitive silver chlorobromide emulsion (Em-G) | 0.17 |
| | Magenta coupler (MC-10) | 0.23 |
| | Dye-image stabilizer (ST-3) | 0.20 |
| | Dye-image stabilizer (ST-4) | 0.17 |
| | DIDP | 0.13 |
| | DBP | 0.13 |

-continued

| Layer | Composition | Amount added (in g/m$^2$) |
|---|---|---|
| Layer 2 (Interlayer) | Gelatin | 1.20 |
| | Antistaining agent (HQ-2) | 0.03 |
| | Antistaining agent (HQ-3) | 0.03 |
| | Antistaining agent (HQ-4) | 0.05 |
| | Antistaining agent (HQ-5) | 0.23 |
| | DIDP | 0.06 |
| | Compound (F-1) | 0.002 |
| Layer 1 (Blue-sensitive layer) | Gelatin | 1.20 |
| | Blue-sensitive silver chlorobromide emulsion (Em-B) | 0.26 |
| | Yellow coupler (YC-1) | 0.80 |
| | Dye-image stabilizer (ST-1) | 0.30 |
| | Dye-image stabilizer (ST-2) | 0.20 |
| | Antistaining agent (HQ-1) | 0.02 |
| | DNP | 0.20 |
| Support | Polyethylene-laminated paper | |

In the table, the amounts of the silver halide emulsions added are indicated in terms of the silver contents, respectively.

ST-1

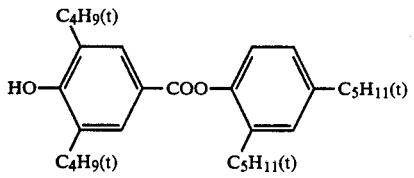

ST-2

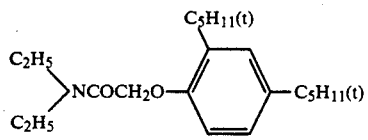

ST-3

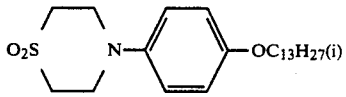

ST-4

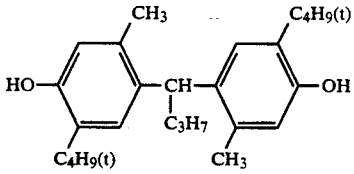

YC-1

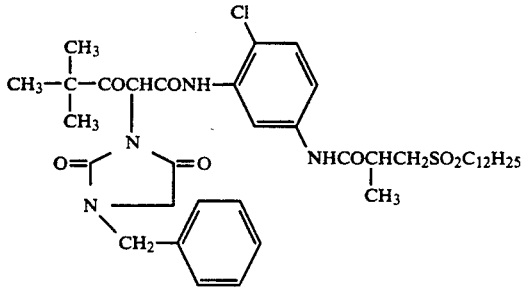

UV-1

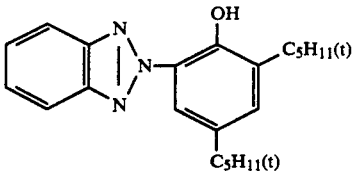

UV-2

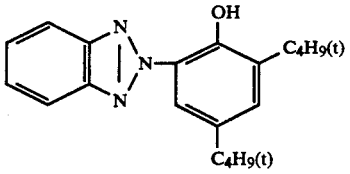

UV-3

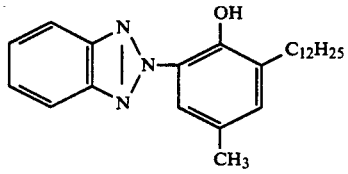

DBP: Dibutyl phthalate,

DOP: Dioctyl phthalate,

DNP: Dinonyl phthalate,

DIDP: Diisodecyl phthalate,

PVP: Polyvinyl pyrrolidone,

HQ-1

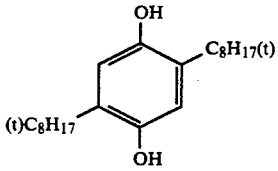

HQ-2

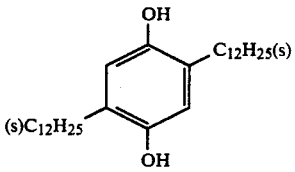

HQ-3

-continued

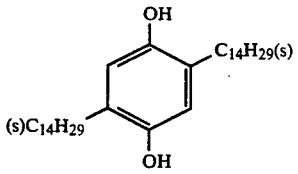

HQ-4

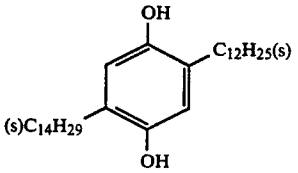

HQ-5

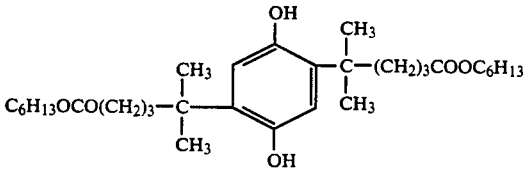

HBS-1

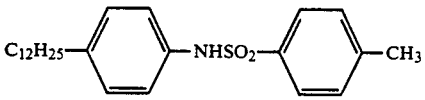

SU-1

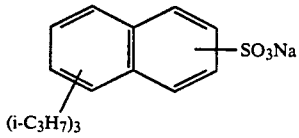

SU-2

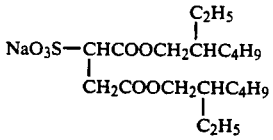

H-1

$C(CH_2SO_2CH{=}CH_2)_4$

AI-1

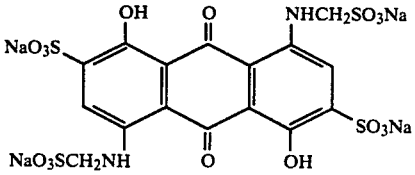

AI-2

-continued

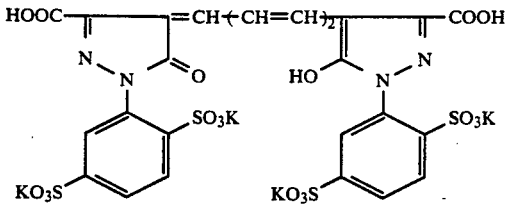

AI-3

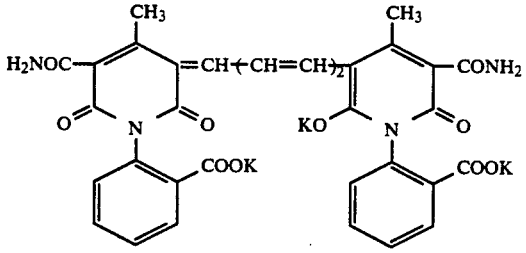

H-2

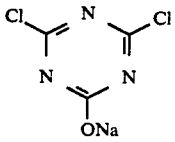

F-1

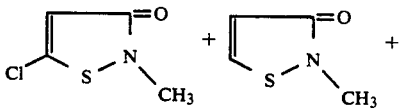

(50%) (46%)

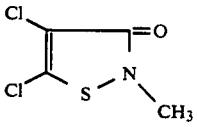

(4%) mol ratio

Procedures for Preparing a Blue-Sensitive Silver Halide Emulsion

To 1000 cc of an aqueous 2% gelatin solution being kept at a temperature of 40° C., the following Solution A and Solution B were each added at the same time while controlling the pAg=6.5 and pH=3.0 by taking 30 minutes and Solution C and Solution D were each added at the same time while controlling the pAg=7.3 and pH=5.5 by taking 180 minutes, respectively.

At this time, pAg was controlled in accordance with the method described in JP OPI Publication No. 59-45437/1984 and pH was controlled using an aqueous sulfuric acid or sodium hydroxide solution.

| | |
|---|---|
| (Solution A) | |
| Sodium chloride | 3.42 g |
| Potassium bromide | 0.03 g |
| Add water to make | 200 cc. |
| (Solution B) | |
| Silver nitrate | 10 g |
| Add water to make | 200 cc. |
| (Solution C) | |
| Sodium chloride | 102.7 g |
| Potassium bromide | 1.0 g |

-continued

| | |
|---|---|
| Add water to make | 600 cc. |
| (Solution D) | |
| Silver nitrate | 300 g |
| Add water to make | 600 cc. |

After completing the addition, a desalination was carried out with an aqueous solution of 5% Demol N (manufactured by Kao-Atlas Co. and an aqueous solution of 20% magnesium sulfate and the resulting demineralized solution was mixed with an aqueous gelatin solution, so that a monodispersed cubic emulsion EMP-1 having an average grain size of 0.85 μm, a grain size distribution variation coefficient of 0.07 and a silver chloride content of 99.5 mol % could be prepared.

The resulting EMP-1 was subjected to the optimum chemical sensitization by making use of the following compounds at 50° C., so that a blue-sensitive silver halide emulsion (Em-B) could be prepared.

| | |
|---|---|
| Sodium thiosulfate | 0.8 mg/mol of AgX |
| Chloroauric acid | 0.5 mg/mol of AgX |
| Stabilizer STAB-1 | $6 \times 10^{-4}$ mols/mol of AgX |
| Sensitizing dye BS-1 | $4 \times 10^{-4}$ mols/mol of AgX |
| Sensitizing dye BS-2 | $1 \times 10^{-4}$ mols/mol of AgX |

Procedures for Preparing a Green-Sensitive Silver Halide Emulsion

Monodispersed cubic emulsion EMP-2 was prepared so as to have an average grain size of 0.43 μm, a variation coefficient of 0.08 and a silver chloride content of 99.5%, in the same manner as in EMP-1 except that both of the time for adding Solution A and Solution B and the time for adding Solution C and Solution D were each changed.

The resulting EMP-2 was subjected to an optimum chemical sensitization by making use of the following compounds at 55° C., so that green-sensitive silver halide emulsion (Em-G) was prepared.

| | |
|---|---|
| Sodium thiosulfate | 1.5 mg/mol of AgX |
| Chloroauric acid | 1.0 mg/mol of AgX |
| Stabilizer STAB-1 | $6 \times 10^{-4}$ mols/mol of AgX |
| Sensitizing dye GS-1 | $4 \times 10^{-4}$ mols/mol of AgX |

Procedures for Preparing a Red-Sensitive Silver Halide Emulsion

Monodispersed cubic emulsion EMP-3 was prepared so as to have an average grain size of 0.50 μm, a variation coefficient of 0.08 and a silver chloride content of 99.5%, in the same manner as in EMP-1 except that both of the time for adding Solution A and Solution B and the time for adding Solution C and Solution D were each changed.

The following metal compounds were added to the foregoing Solution C.

| | |
|---|---|
| $K_2IrCl_6$ | $3.8 \times 10^{-8}$ mols/mol of AgX |
| $K_4Fe(CN)_6$ | $1.2 \times 10^{-5}$ mols/mol of AgX |

The resulting EMP-3 was subjected to an optimum chemical sensitization by making use of the following compounds at 60° C., so that red-sensitive silver halide emulsion (Em-R) was prepared.

| | |
|---|---|
| Sodium thiosulfate | 1.8 mg/mol of AgX |
| Chloroauric acid | 2.0 mg/mol of AgX |
| Stabilizer STAB-1 | $6 \times 10^{-4}$ mols/mol of AgX |
| Sensitizing dye RS-1 | $1 \times 10^{-4}$ mols/mol of AgX |

BS-1

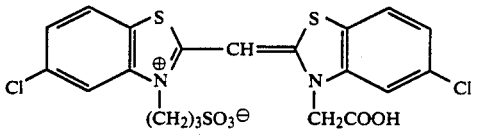

BS-2

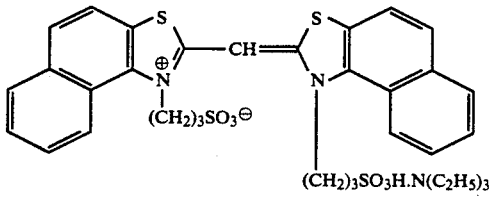

GS-1

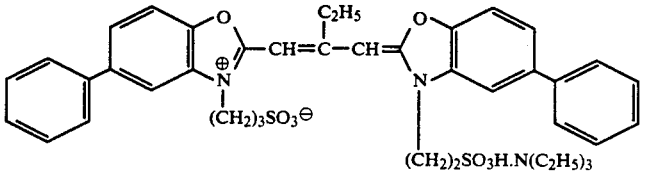

STAB-1

-continued

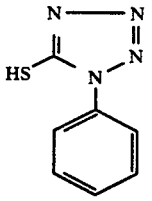

RS-1

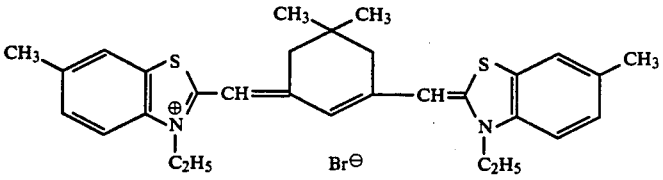

Next, Samples 1-2 through 1-28 were each prepared in the same manner as in Sample 1-1, except that the yellow coupler (YC-1) used in Layer 1 of Sample 1-1 was changed as shown in Table 3, that the compounds represented Formula [I] of the invention or the compounds (STB-2 through STB-4), which were other than the compounds of the invention, were added, as shown in Table 3, so as to be an amount added of $5\times10^{-6}$ mols per a unit area (or $m^2$) of the sample and that the kinds and amount added of the dyes in Layer 4 were changed as shown in Table 3.

TABLE 1

| Sample No. | Compound added to Layer: Yellow coupler | Compound having Formula [I] | Dye added to Layer 4 | | Remarks |
|---|---|---|---|---|---|
| 1-1 | YC-1 | STB-2 | AI-1 | (30)* | Comparison |
| 1-2 | " | Exemp. 13 | " | | " |
| 1-3 | " | " | Exemp. III-25 | (30) | " |
| 1-4 | Exemp. (4) | — | — | | " |
| 1-5 | " | STB-2 | AI-2 | (25) | " |
| 1-6 | " | STB-3 | " | (30) | " |
| 1-7 | " | Exemp. 1 | " | (30) | " |
| 1-8 | " | STB-3 | Exemp. III-12 | (30) | " |
| 1-9 | " | Exemp. 1 | Exemp. III-16 | (30) | Invention |
| 1-10 | Exemp. (6) | STB-3 | AI-3 | (25) | Comparison |
| 1-11 | " | Exemp. 7 | " | (25) | " |
| 1-12 | " | STB-3 | Exemp. III-46 | (30) | " |
| 1-13 | " | Exemp. 7 | Exemp. III-14 | (25) | Invention |
| 1-14 | Exemp. (8) | STB-4 | Exemp. III-49 | (30) | Comparison |
| 1-15 | " | Exemp. 15 | AI-1 | (30) | " |
| 1-16 | " | " | Exemp. III-2 | (25) | Invention |
| 1-17 | Exemp. (1) | STB-2 | Exemp. III-26 | (30) | Comparison |
| 1-18 | " | Exemp. 13 | AI-2 | (30) | " |
| 1-19 | " | " | AI-3 | (25) | " |
| 1-20 | " | " | Exemp. III-14 | (30) | Invention |
| 1-21 | " | " | Exemp. III-35 | (30) | " |
| 1-22 | Exemp. (3) | STB-3 | Exemp. III-28 | (30) | Comparison |
| 1-23 | " | Exemp. 13 | Exemp. III-36 | (30) | Invention |
| 1-24 | Exemp. (2) | STB-3 | Exemp. III-41 | (30) | Comparison |
| 1-25 | " | Exemp. 13 | Exemp. III-35 | (30) | Invention |
| 1-26 | Exemp. (7) | " | Exemp. III-14 | (30) | " |
| 1-27 | Exemp. (31) | " | Exemp. III-37 | (30) | " |
| 1-28 | Exemp. (5) | " | Exemp. III-7 | (30) | " |

Wherein, ( )* indicates an amount added (in terms of $mg/m^2$)

STB-2

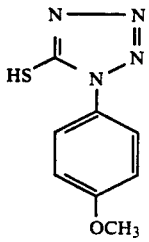

STB-3

TABLE 1-continued

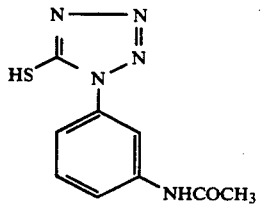

STB-4

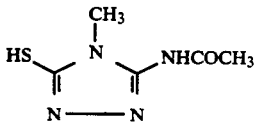

After exposing the resulting samples to light in an ordinary method, the exposed samples were processed in the following processing steps.

| Processing step | Temperature | Time |
|---|---|---|
| Color developing | 35.0 ± 0.3° C. | 45 sec. |
| Bleach-fixing | 35.0 ± 0.5° C. | 45 sec. |
| Stabilizing | 30~34° C. | 90 sec. |
| Drying | 60~80° C. | 60 sec. |

| Color developer | |
|---|---|
| Water | 800 cc |
| Triethanol amine | 10 g |
| N,N-diethyl hydroxylamine | 5 g |
| Potassium bromide | 0.02 g |
| Potassium chloride | 2 g |
| Potassium sulfite | 0.3 g |
| 1-hydroxyethylidene-1,1-diphosphoric acid | 1.0 g |
| Ethylenediamine tetraacetic acid | 1.0 g |
| Disodium catechol-3,5-disulfonate | 1.0 g |
| N-ethyl-N-β-methanesulfonamidoethyl-3-methyl-4-aminoaniline sulfate | 4.5 g |
| Fluorescent whitening agent, (4,4'-diaminostilbene disulfonic acid derivative) | 1.0 g |
| Potassium bromide | 27 g |
| Add water to make in total | 1 liter |
| Adjust pH to be | pH = 10.10 |
| **Bleach-fixer** | |
| Ferric ammonium ethylenediamine tetraacetate, dihydrate | 60 g |
| Ethylenediamine tetraacetic acid | 3 g |
| Ammonium thiosulfate, (in an aqueous 70% solution) | 100 cc |
| Ammonium sulfite, (in an aqueous 40% solution) | 27.5 cc |
| Add water to make in total | 1 liter |
| Adjust pH with potassium carbonate or glacial acetic acid to be | pH = 5.7 |
| **Stabilizer** | |
| 5-chloro-2-methyl-4-isothiazoline-3-one | 1.0 g |
| Ethylene glycol | 1.0 g |
| 1-hydroxyethylidene-1,1-diphosphoric acid | 2.0 g |
| Ethylenediamine tetraacetic acid | 1.0 g |
| Ammonium hydroxide, (in an aqueous 20% solution) | 3.0 g |
| Fluorescent whitening agent, (4,4'-diaminostilbene diphosphonic acid derivative) | 1.5 g |
| Add water to make in total | 1 liter |
| Adjust pH with sulfuric acid or potassium hydroxide to be | pH = 7.0 |

Next, the resulting samples were each evaluated as follows.

Sensitometery

With each of the processed samples, the sensitivity, gradation and maximum density (Dmax) thereof were obtained by making use of a densitometer, Model PDA-65 (manufactured by Konica Corp.)

Sensitivity (S)=The reciprocal of an exposure quantity capable of providing a reflection density of 0.8

Gradation (γ)=The inclination of the straight line connecting the points of the reflection densities of 0.5 and 1.5 to each other.

Image Sharpness

Through a resolving power test chart was exposed to red light each of the samples and the exposed samples were each processed. After that, the densities of the resulting cyan images were measured with a microdensitometer, Model PDM-5 (manufactured by Konica Corp.). The sharpness were each evaluated in terms of the values represented by the following formula.

Sharpness (R)=(Dmax−Dmin of a printed image having 5 thick lines/mm)/(Dmax−Dmin in a substantially large area)

wherein

Dmax: a maximum density; and

Dmin: a minimum density

It indicates that the greater a sharpness value is, the more the sharpness is excellent.

Whiteness of Background

By making use of a Konica Color.Printer.Processor, Model CL-PP1701QA (manufactured by Konica Corp.) and a processing solution, CPK-2-20, each of the samples was processed continuously until the total cumulated amount of the replenishment thereof exceeded the amount of the solution at the start, and the resulting blue light reflection density ($Dmin^B$) and red light reflection density ($Dmin^R$) each in the unexposed area were measured in the same manner as before.

The smaller the values of $Dmin^R$ and $Dmin^B$ are, the more the white background property is excellent. It is acceptable when the values of $Dmin^B$ and $Dmin^R$ are each not higher than 0.02. When exceeding 0.025, the whiteness deterioration became apparent even in visual observation. When exceeding 0.03, the photographic qualities were seriously deteriorated.

Color Reproduction

A color chart (manufactured by Macbeth Co.) was photographed on a color negative film, Konica Color XG-100 (manufactured by Konica Corp.). The resulting exposed film was developed and the tone of the greyscale portion was adjusted. After that, each of the samples was exposed to light and processed. The color reproduction of each hue of the resulting prints was visually evaluated.

The results of the evaluation of the sensitivity, gradation, white background property, sharpness and so forth will be collectively shown in Table 2.

TABLE 2

| Sample No. | Sensitometry $Dmax^B$ | White background DminB | DminR | Sharpness (R) | Remarks |
|---|---|---|---|---|---|
| 1-1 | 2.43 | 0.023 | 0.026 | 0.62 | Comparison |
| 1-2 | 2.44 | 0.022 | 0.026 | 0.62 | " |
| 1-3 | 2.44 | 0.024 | 0.019 | 0.69 | " |
| 1-4 | 2.48 | 0.025 | 0.016 | 0.43 | " |
| 1-5 | 2.39 | 0.022 | 0.027 | 0.59 | " |
| 1-6 | 2.41 | 0.024 | 0.032 | 0.63 | " |
| 1-7 | 2.44 | 0.020 | 0.031 | 0.63 | " |
| 1-8 | 2.40 | 0.029 | 0.018 | 0.71 | " |
| 1-9 | 2.47 | 0.016 | 0.019 | 0.72 | Invention |
| 1-10 | 2.41 | 0.022 | 0.028 | 0.67 | Comparison |
| 1-11 | 2.46 | 0.020 | 0.028 | 0.67 | " |
| 1-12 | 2.39 | 0.027 | 0.016 | 0.70 | " |
| 1-13 | 2.47 | 0.017 | 0.017 | 0.70 | Invention |
| 1-14 | 2.41 | 0.030 | 0.018 | 0.71 | Comparison |
| 1-15 | 2.49 | 0.022 | 0.026 | 0.62 | " |
| 1-16 | 2.51 | 0.016 | 0.017 | 0.75 | Invention |
| 1-17 | 2.45 | 0.029 | 0.015 | 0.71 | Comparison |
| 1-18 | 2.55 | 0.021 | 0.031 | 0.63 | " |
| 1-19 | 2.54 | 0.020 | 0.028 | 0.67 | " |
| 1-20 | 2.56 | 0.016 | 0.018 | 0.73 | Invention |
| 1-21 | 2.57 | 0.015 | 0.015 | 0.77 | " |
| 1-22 | 2.46 | 0.031 | 0.016 | 0.72 | Comparison |
| 1-23 | 2.56 | 0.016 | 0.015 | 0.76 | Invention |
| 1-24 | 2.41 | 0.027 | 0.018 | 0.71 | Comparison |
| 1-25 | 2.53 | 0.014 | 0.015 | 0.77 | Invention |
| 1-26 | 2.53 | 0.017 | 0.018 | 0.73 | " |
| 1-27 | 2.52 | 0.016 | 0.016 | 0.75 | " |
| 1-28 | 2.49 | 0.017 | 0.016 | 0.73 | " |

About the color reproduction, Sample Nos. 1-1 through 1-3 were each not good enough because the yellow and yellowish green hues in particular were visually observed to be slightly turbid, while Samples Nos. 1-4 through 1-28 could provide the color-reproduction, without any color turbidity, nearly as same as the original.

From the results shown in Table 2, it was proved to be that, when making use of dye [III] of the invention, a sharpness can be higher and $Dmin^R$ can also be lower in respect to the white background property. However, in the samples applied, at the same time, with the yellow coupler of the invention having an excellent color reproduction and the dye [III] of the invention, the fog production was increased and the white background property was also deteriorated. Further, the samples were unsatisfactory even when an inhibitor other than the invention was used and, in addition, they were also unsatisfactory, because the color developability was lowered too.

In contrast to the above, when making use of the inhibitor [I] of the invention in the samples applied with the yellow coupler [II] of the invention and the dye [III] of the invention, it proved to be that the fog production was lowered and, amazingly, the color developability (or $Dmax^B$) was least deteriorated.

From the facts described above, a silver halide color photographic light sensitive material could be prepared so as to have every one of the excellent color reproduction, sharpness and white background property which are the key characteristics for making image qualities higher and to provide a high density yellow image forming dyes, only when making use of the samples applied with the yellow coupler [II]of the invention, the dye [III] of the invention and the inhibitor [I] of the invention.

EXAMPLE-2

Samples 2-1 through 2-14 were each prepared in the same manner as in Example-1, except that the yellow coupler used in Layer 1 of Sample 1-4 of Example-1 and Compound [I] of the invention used in Layer 1 of Example-1 or Compounds TSB-2 through TSB-4 other than the invention (of which the amounts added were each $6\times10^{-6}$ mols per the unit area, $m^2$, of the samples), each of them was changed as shown in Table-3 and that Exemplified compound III-1 was so added into Layer-4 as to be in an amount added of 25 mg per the unit area, $m^2$, of the samples.

When making combination use of Compound [I] of the invention and STB-2 through STB-4, the compounds other than invention, they were used in the mol ratio of the former to the latter of 2:1.

The resulting samples were each exposed to blue-light in an ordinary method and then processed in the same processing steps as in Example-1 with continuously replenishing by making use of a Konica Color.-Printer.Processor Model CL-PP1701QA (manufactured by Konica Corp.) until the cumulated replenishing amount exceeded the amount doubled the original amount. After that, the same evaluation as in Example-1 and the following evaluation were carried out.

Spectral Absorption Characteristics of the Yellow Image Forming Dye

The spectral reflection absorption of the resulting samples were each measured by making use of a color analyzer (manufactured by Hitachi, Ltd.). When the spectral reflection density became a value of 1.0 in the absorption maximum wavelength, the spectral reflection density value in 560 nm in the unexposed area (that is, the white background) was deducted from the spectral reflection density value in 560 nm. The resulting values of the samples were obtained as the values of $\Delta D\lambda 560$.

The results of the above-mentioned evaluation were also shown in Table 3.

TABLE 3

| Sample No. | Compound added to Layer 1: Yellow coupler | Compound of Formula [I] | Sensitometry $Dmax^B$ | Yellow spectral absorption $\Delta D\lambda_{560}$ | Remarks |
|---|---|---|---|---|---|
| 2-1 | Exemp. (4) | — | 2.48 | +0.04 | Comparison |
| 2-2 | Exemp. (4) | STB-3 | 2.40 | +0.04 | Comparison |
| 2-3 | Exemp. (4) | Exemp. 26 | 2.47 | +0.02 | Invention |
| 2-4 | Exemp. (30) | — | 2.51 | +0.05 | Comparison |
| 2-5 | Exemp. (30) | STB-4 | 2.38 | +0.07 | Comparison |
| 2-6 | Exemp. (30) | Exemp. 2 | 2.48 | +0.02 | Invention |
| 2-7 | Exemp. (3) | — | 2.57 | +0.06 | Comparison |
| 2-8 | Exemp. (3) | STB-2 | 2.45 | +0.05 | Comparison |
| 2-9 | Exemp. (3) | Exemp. 1 | 2.55 | +0.01 | Invention |

TABLE 3-continued

| Sample No. | Compound added to Layer 1: Yellow coupler | Compound added to Layer 1: Compound of Formula [I] | Sensitometry $Dmax^B$ | Yellow spectral absorption $\Delta D\lambda_{560}$ | Remarks |
|---|---|---|---|---|---|
| 2-10 | Exemp. (3) | Exemp. 13/STB-3 | 2.56 | +0.01 | Invention |
| 2-11 | Exemp. (1) | — | 2.56 | +0.05 | Comparison |
| 2-12 | Exemp. (1) | STB-3 | 2.44 | +0.06 | Comparison |
| 2-13 | Exemp. (1) | Exemp. 13 | 2.55 | +0.01 | Invention |
| 2-14 | Exemp. (1) | Exemp. 1/STB-2 | 2.53 | +0.01 | Invention |

It was proved from the results shown in Table-3 that, out of the silver halide color photographic light sensitive materials applied with the yellow coupler of the invention, the samples not applied with the inhibitor of the invention or applied independently with other inhibitors than that of the invention increased their spectral reflection density of 560 nm in the longer wavelength region out of the spectral absorption characteristics of the yellow image forming dyes, and therefore that the color reproduction was spoiled without providing any clear color forming dye image.

In contrast to the above, the samples applied with Inhibitor [I] of the invention had each a very few or almost none of the increase in the spectral reflection density in the longer wavelength region and, therefore, the yellow coupler of the invention could fully display the excellent color reproduction.

In the latter half of the running treatments, there is a tendency to increase the above-mentioned spectral reflection density more in the longer wavelength region, as compared to the time when making the start of the running treatments.

The samples of the invention were also proved to be excellent in both fog prevention and sharpness.

According to the invention, it was possible to provide a silver halide color photographic light sensitive material excellent in sharpness and white background property, while being capable of satisfactorily displaying the yellow coupler characteristics including the excellent color reproduction.

What is claimed is:

1. A silver halide color photographic light sensitive material comprising a support bearing thereon photographic component layers including at least one light sensitive silver halide emulsion layer, wherein at least one of said component layers contains a compound represented by the following Formula [I], said silver halide emulsion contains a compound represented by the following Formula [II] and at least one of said component layers contains a compound represented by the following Formula [III], Formula [I]

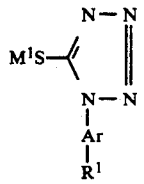

wherein Ar represents an aromatic group; and $R^1$ represents $—OR^2$, $—N(R^3)SO_2R^4$ or $—COOM^2$ in which $R^2$ represents a hydrocarbon group having 2 or more carbon atoms, $R^3$ represents a hydrogen atom or a hydrocarbon group, and $R^4$ represents a hydrocarbon group; and wherein $M^1$ and $M^2$ represent each a hydrogen atom, an alkali metal atom, an alkaline earth metal atom or an ammonium group Formula [II]

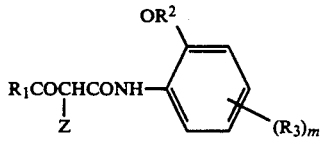

wherein $R_1$ represents an alkyl group or a cycloalkyl group; $R^2$ represents an alkyl group, a cycloalkyl group or an aryl group; $R_3$ represents a group substitutable on a benzene ring; and m is an integer of 0 to 4, provided that when m is 2 or more, $R_3$s may be the same with or different from each other; and Z represents a hydrogen atom or a group capable of splitting off upon reaction with the oxidized product of a developing agent, Formula [III]

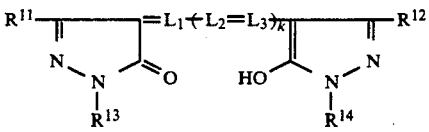

wherein $R^{11}$ and $R^{12}$ represent each —CN, $—COR^{15}$, $—COOR^{15}$ or $—CONR^{16}R^{17}$; $R^{13}$ and $R^{14}$ represent each a hydrogen atom, an alkyl group, a cycloalkyl group, an aryl group or a heterocyclic group; $L_1$, $L_2$ and $L_3$ represent each a methine group; k is an integer of 0, 1 or 2, provided that when k is 2, $—(L_2=L_3)—$ groups may be the same or different from each other; and $R^{15}$ represents an alkyl group or an aryl group; $R^{16}$ and $R^{17}$ represent each a hydrogen atom, an alkyl group, an alkenyl group, an aryl group or a heterocyclic group, provided that $R^{16}$, $R^{17}$ and a nitrogen atom adjacent thereto may couple to form a 5- or 6-membered ring and that $R^{16}$ and $R^{17}$ does not represent hydrogen atoms at the same time.

2. The color photographic material of claim 1, wherein said compound represented by Formula [I] is contained in an amount of $1\times10^{-7}$ to $1\times10^{-1}$ mol per mol of silver halide.

3. The color photographic material of claim 1, wherein in Formula [II], $R_3$ represents $—NHCOR_5$, in which $R_5$ represents an alkyl group.

4. The color photographic material of claim 1, wherein said compound represented by Formula [III] is contained in an amount of 1 to 200 mg per $m^2$ of the photographic material.

5. The color photographic material of claim 1, wherein said silver halide emulsion layer comprises a silver halide emulsion containing silver halide grains having a chloride content of not less than 95 mol %.

6. The color photographic material of claim 5, wherein said silver halide emulsion is a monodispersed silver halide emulsion having a variation coefficient of 0.22.

7. The color photographic material of claim 1, wherein said silver halide emulsion layer further contains a compound represented by the following Formula [XX], [XXI], [XXII] or [XXIII], Formula [XX]

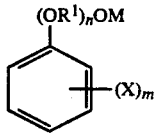

wherein $R^1$ represents an alkylene group; M represents a hydrogen atom, an alkali metal or an alkyl group; X represents a halogen atom or an alkyl, cycloalkyl, aryl, carboxy, amino, hydroxy, sulfo, nitro or alkoxy group; m is an integer of 1 to 5 and n is 0 or 1, Formula [XXI]

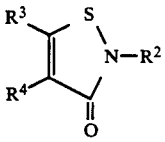

wherein $R^2$ represents a hydrogen atom or an alkyl, cycloalkyl, alkenyl, aralkyl, aryl, alkoxy group or heterocyclic group, or —CONHR, in which R represents a hydrogen atom or an alkyl, aryl, alkylthio, arylthio, alkylsulfonyl or arylsulfonyl group; $R^3$ and $R^4$ represent each a hydrogen or halogen atom, an alkyl, cycloalkyl, aryl, heterocyclic, cyano, alkylthio, arylthio, alkylsulfoxide, alkylsulfonyl or alkylsulfinyl group and $R^3$ and $R^4$ may couple to each other to form a benzene ring which may have a substituent, Formula [XXII]

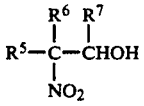

wherein $R^5$ and $R^6$ represent each a hydrogen or halogen atom, an alkyl group having 1 to 5 carbon atoms or a hydroxymethyl group; and $R^7$ a hydrogen atom or an alkyl group having 1 to 5 carbon atoms, Formula [XXIII]

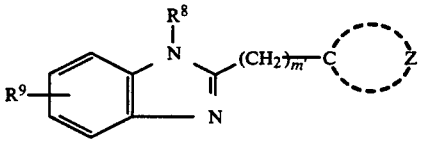

wherein $R^8$ represents a hydrogen atom or an alkyl or aryl group; $R^9$ represents a hydrogen or halogen atom or an alkyl, aryl, alkoxy, thiazolyl, nitro, carboxy, sulfo, sulfamoyl or hydroxy group; Z represents an atomic group necessary to form a thiazole ring; and m' is 0 or 1.

8. The color photographic material of claim 2, wherein said compound represented by Formula [III] is contained in an amount of 1 to 200 mg per $m^2$ of the photographic material.

9. The color photographic material of claim 8, wherein said compound represented by Formula [II] is contained in an amount of 0.05 to 0.8 mole per mole of silver halide.

10. The color photographic material of claim 8, wherein in Formula [II], $R_3$ represents —$NHCOR_5$, in which $R_5$ represents an alkyl group.

11. The color photographic material of claim 10, wherein said silver halide emulsion layer comprises a silver halide emulsion containing silver halide grains having a chloride content of not less than 95 mol %.

12. The color photographic material of claim 11, wherein said silver halide emulsion is a monodispersed silver halide emulsion having a variation coefficient of 0.22.

* * * * *